US009836920B2

(12) United States Patent
Arnone et al.

(10) Patent No.: US 9,836,920 B2
(45) Date of Patent: Dec. 5, 2017

(54) HYBRID GAME WITH MANUAL TRIGGER OPTION

(71) Applicant: Gamblit Gaming, LLC, Glendale, CA (US)

(72) Inventors: Miles Arnone, Sherborn, MA (US); Caitlyn Ross, Watertown, MA (US)

(73) Assignee: Gamblit Gaming, LLC, Glendale, CA (US)

( * ) Notice: Subject to any disclaimer, the term of this patent is extended or adjusted under 35 U.S.C. 154(b) by 135 days.

(21) Appl. No.: 14/586,645

(22) Filed: Dec. 30, 2014

(65) Prior Publication Data

US 2015/0161847 A1 Jun. 11, 2015

Related U.S. Application Data

(63) Continuation of application No. PCT/US2013/048987, filed on Jul. 1, 2013.

(60) Provisional application No. 61/666,863, filed on Jun. 30, 2012.

(51) Int. Cl.
*G07F 17/32* (2006.01)

(52) U.S. Cl.
CPC ..... *G07F 17/3244* (2013.01); *G07F 17/326* (2013.01)

(58) Field of Classification Search
CPC . G07F 17/326; G07F 17/3267; G07F 17/3269
USPC ..... 463/16–20, 25
See application file for complete search history.

(56) References Cited

U.S. PATENT DOCUMENTS

| | | | |
|---|---|---|---|
| 5,413,357 | A | 5/1995 | Schulze et al. |
| 5,718,429 | A | 2/1998 | Keller |
| 5,785,592 | A | 7/1998 | Jacobsen |
| 5,853,324 | A | 12/1998 | Kami et al. |
| 5,963,745 | A | 10/1999 | Collins et al. |
| 6,050,895 | A | 4/2000 | Luciano |
| 6,165,071 | A | 12/2000 | Weiss |
| 6,227,974 | B1 | 5/2001 | Eilat |
| 6,267,669 | B1 | 7/2001 | Luciano |
| 6,685,563 | B1 | 2/2004 | Meekins et al. |
| 6,712,693 | B1 | 3/2004 | Hettinger |
| 6,761,632 | B2 | 7/2004 | Bansemer et al. |

(Continued)

FOREIGN PATENT DOCUMENTS

| | | | | |
|---|---|---|---|---|
| JP | 20040097610 | | 4/2004 | |
| WO | 2011/109454 | * | 9/2011 | ..... G07F 17/326 |
| WO | 2011109454 | | 9/2011 | |

OTHER PUBLICATIONS

U.S. Appl. No. 14/205,303 Arnone, et al., filed Mar. 11, 2014 (Applicant believes reference available to Examiner via Pair).

(Continued)

*Primary Examiner* — Michael Cuff
(74) *Attorney, Agent, or Firm* — Caitlyn Ross

(57) ABSTRACT

Systems and method for providing a gambling hybrid game having manual triggering of gambling events is disclosed. The systems and method involve providing a proposition of a gambling event to a user and receiving an input accepting the proposition from a user. The gambling event that is associated with the proposition is then resolved. The results of the gambling event are then determined and the wagers are resolved. The results of the gambling event are then used to change variables in a set of game variables that are applied in the game.

15 Claims, 16 Drawing Sheets

(56) References Cited

U.S. PATENT DOCUMENTS 6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,938,727 B1 5/2011 Konkle
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,475,266 B2 7/2013 Arnone
8,480,470 B2 7/2013 Napolitano et al.
8,622,809 B1 1/2014 Arora et al.
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181777 A1 7/2009 Christiani
2009/0221355 A1 9/2009 Dunaevsky et al.
2009/0239610 A1 9/2009 Olive
2009/0247272 A1 10/2009 Abe
2009/0270164 A1 10/2009 Seelig

(56) References Cited

U.S. PATENT DOCUMENTS

| | | | |
|---|---|---|---|
| 2009/0275411 | A1 | 11/2009 | Kisenwether |
| 2009/0291755 | A1 | 11/2009 | Walker et al. |
| 2009/0309305 | A1 | 12/2009 | May |
| 2009/0312093 | A1 | 12/2009 | Walker et al. |
| 2009/0325686 | A1 | 12/2009 | Davis |
| 2010/0004058 | A1 | 1/2010 | Acres |
| 2010/0016056 | A1 | 1/2010 | Thomas et al. |
| 2010/0029373 | A1 | 2/2010 | Graham et al. |
| 2010/0035674 | A1 | 2/2010 | Slomiany |
| 2010/0056247 | A1 | 3/2010 | Nicely |
| 2010/0056260 | A1 | 3/2010 | Fujimoto |
| 2010/0062836 | A1 | 3/2010 | Young |
| 2010/0093420 | A1 | 4/2010 | Wright |
| 2010/0093444 | A1 | 4/2010 | Biggar et al. |
| 2010/0105454 | A1 | 4/2010 | Weber |
| 2010/0120525 | A1 | 5/2010 | Baerlocher et al. |
| 2010/0124983 | A1 | 5/2010 | Gowin et al. |
| 2010/0137047 | A1 | 6/2010 | Englman et al. |
| 2010/0174593 | A1 | 7/2010 | Cao |
| 2010/0184509 | A1 | 7/2010 | Sylla et al. |
| 2010/0203940 | A1 | 8/2010 | Alderucci et al. |
| 2010/0210344 | A1 | 8/2010 | Edidin et al. |
| 2010/0227672 | A1 | 9/2010 | Amour |
| 2010/0227688 | A1 | 9/2010 | Lee |
| 2010/0240436 | A1 | 9/2010 | Wilson et al. |
| 2010/0304825 | A1 | 12/2010 | Davis |
| 2010/0304839 | A1 | 12/2010 | Johnson |
| 2010/0304842 | A1 | 12/2010 | Friedman et al. |
| 2011/0009177 | A1 | 1/2011 | Katz |
| 2011/0009178 | A1 | 1/2011 | Gerson |
| 2011/0045896 | A1 | 2/2011 | Sak et al. |
| 2011/0077087 | A1 | 3/2011 | Walker et al. |
| 2011/0082571 | A1 | 4/2011 | Murdock et al. |
| 2011/0105206 | A1 | 5/2011 | Rowe et al. |
| 2011/0107239 | A1 | 5/2011 | Adoni |
| 2011/0109454 | A1 | 5/2011 | McSheffrey |
| 2011/0111820 | A1 | 5/2011 | Filipour |
| 2011/0111837 | A1 | 5/2011 | Gagner |
| 2011/0111841 | A1 | 5/2011 | Tessmer |
| 2011/0118011 | A1 | 5/2011 | Filipour et al. |
| 2011/0201413 | A1 | 8/2011 | Oberberger |
| 2011/0207523 | A1 | 8/2011 | Filipour et al. |
| 2011/0212766 | A1 | 9/2011 | Bowers |
| 2011/0212767 | A1 | 9/2011 | Barclay |
| 2011/0218028 | A1 | 9/2011 | Acres |
| 2011/0218035 | A1 | 9/2011 | Thomas |
| 2011/0230258 | A1 | 9/2011 | Van Luchene |
| 2011/0230260 | A1 | 9/2011 | Morrow et al. |
| 2011/0230267 | A1 | 9/2011 | Van Luchene |
| 2011/0244944 | A1 | 10/2011 | Baerlocher |
| 2011/0263312 | A1 | 10/2011 | De Waal |
| 2011/0269522 | A1 | 11/2011 | Nicely et al. |
| 2011/0275440 | A1 | 11/2011 | Faktor |
| 2011/0287828 | A1 | 11/2011 | Anderson et al. |
| 2011/0287841 | A1 | 11/2011 | Watanabe |
| 2011/0312408 | A1 | 12/2011 | Okuaki |
| 2011/0319169 | A1 | 12/2011 | Lam |
| 2012/0004747 | A1 | 1/2012 | Kelly |
| 2012/0028718 | A1 | 2/2012 | Barclay et al. |
| 2012/0058814 | A1 | 3/2012 | Lutnick |
| 2012/0077569 | A1 | 3/2012 | Watkins |
| 2012/0108323 | A1 | 5/2012 | Kelly |
| 2012/0135793 | A1 | 5/2012 | Antonopoulos |
| 2012/0202587 | A1 | 8/2012 | Allen |
| 2012/0302311 | A1 | 11/2012 | Luciano |
| 2012/0322545 | A1 | 12/2012 | Arnone et al. |
| 2013/0029760 | A1 | 1/2013 | Wickett |
| 2013/0131848 | A1 | 5/2013 | Arnone et al. |
| 2013/0190074 | A1 | 7/2013 | Arnone et al. |
| 2013/0260869 | A1 | 10/2013 | Basallo et al. |
| 2014/0087801 | A1 | 3/2014 | Nicely et al. |
| 2014/0087808 | A1 | 3/2014 | Basallo et al. |
| 2014/0087809 | A1 | 3/2014 | Leupp et al. |

OTHER PUBLICATIONS

U.S. Appl. No. 14/205,306 Arnone, et al., filed Mar. 11, 2014 (Applicant believes reference available to Examiner via Pair).
U.S. Appl. No. 14/209,485 Arnone, et al., filed Mar. 13, 2014 (Applicant believes reference available to Examiner via Pair).
U.S. Appl. No. 14/214,310 Arnone, et al., filed Mar. 14, 2014 (Applicant believes reference available to Examiner via Pair).
U.S. Appl. No. 14/222,520 Arnone, et al., filed Mar. 21, 2014 (Applicant believes reference available to Examiner via Pair).
U.S. Appl. No. 14/253,813 Arnone, et al., filed Apr. 15, 2014 (Applicant believes reference available to Examiner via Pair).
U.S. Appl. No. 14/255,253 Arnone, et al., filed Apr. 17, 2014 (Applicant believes reference available to Examiner via Pair).
U.S. Appl. No. 14/255,919 Arnone, et al. filed Apr. 17, 2014 (Applicant believes reference available to Examiner via Pair).
U.S. Appl. No. 14/263,988 Arnone, et al. filed Apr. 28, 2014 (Applicant believes reference available to Examiner via Pair).
U.S. Appl. No. 14/270,335 Arnone, et al. filed May 5, 2014 (Applicant believes reference available to Examiner via Pair).
U.S. Appl. No. 14/271,360 Arnone, et al. filed May 6, 2014 (Applicant believes reference available to Examiner via Pair).
U.S. Appl. No. 13/961,849 Arnone, et al. filed Aug. 7, 2013 (Applicant believes reference available to Examiner via Pair).
U.S. Appl. No. 13/746,850 Arnone, et al. filed Jan. 22, 2013 (Applicant believes reference available to Examiner via Pair).
U.S. Appl. No. 14/288,169 Arnone, et al. filed May 27, 2014 (Applicant believes reference available to Examiner via Pair).
U.S. Appl. No. 14/304,027 Arnone, et al. filed Jun. 13, 2014 (Applicant believes reference available to Examiner via Pair).
U.S. Appl. No. 14/306,187 Arnone, et al. filed Jun. 16, 2014 (Applicant believes reference available to Examiner via Pair).
U.S. Appl. No. 14/312,623 Arnone, et al. filed Jun. 24, 2014 (Applicant believes reference available to Examiner via Pair).
U.S. Appl. No. 14/330,249 Arnone, et al. filed Jul. 14, 2014 (Applicant believes reference available to Examiner via Pair).
U.S. Appl. No. 14/339,142 Arnone, et al. filed Jul. 23, 2014 (Applicant believes reference available to Examiner via Pair).
U.S. Appl. No. 14/458,206 Arnone, et al. filed Aug. 12, 2014 (Applicant believes reference available to Examiner via Pair).
U.S. Appl. No. 14/461,344 Arnone, et al. filed Aug. 15, 2014 (Applicant believes reference available to Examiner via Pair).
U.S. Appl. No. 14/462,516 Arnone, et al. filed Aug. 18, 2014 (Applicant believes reference available to Examiner via Pair).
U.S. Appl. No. 14/467,646 Meyerhofer, et al. filed Aug. 25, 2014 (Applicant believes reference available to Examiner via Pair).
U.S. Appl. No. 14/474,023 Arnone, et al. filed Aug. 29, 2014 (Applicant believes reference available to Examiner via Pair).
U.S. Appl. No. 14/486,895 Arnone, et al. filed Sep. 15, 2014 (Applicant believes reference available to Examiner via Pair).
U.S. Appl. No. 14/507,206 Arnone, et al. filed Oct. 6, 2014 (Applicant believes reference available to Examiner via Pair).
U.S. Appl. No. 14/521,338 Arnone, et al. filed Oct. 22, 2014 (Applicant believes reference available to Examiner via Pair.
U.S. Appl. No. 14/535,808 Arnone, et al. filed Nov. 7, 2014 (Applicant believes reference available to Examiner via Pair.
U.S. Appl. No. 14/535,816 Arnone, et al. filed Nov. 7, 2014 (Applicant believes reference available to Examiner via Pair.
U.S. Appl. No. 14/536,231 Arnone, et al. filed Nov. 7, 2014 (Applicant believes reference available to Examiner via Pair.
U.S. Appl. No. 14/536,280 Arnone, et al. filed Nov. 7, 2014 (Applicant believes reference available to Examiner via Pair.
U.S. Appl. No. 14/549,137 Arnone, et al. filed Nov. 20, 2014 (Applicant believes reference available to Examiner via Pair.
U.S. Appl. No. 14/550,802 Arnone, et al. filed Nov. 21, 2014 (Applicant believes reference available to Examiner via Pair.
U.S. Appl. No. 14/555,401 Arnone, et al. filed Nov. 26, 2014 (Applicant believes reference available to Examiner via Pair.
U.S. Appl. No. 14/559,840 Arnone, et al. filed Dec. 3, 2014 (Applicant believes reference available to Examiner via Pair.
U.S. Appl. No. 14/564,834 Arnone, et al. filed Dec. 9, 2014 (Applicant believes reference available to Examiner via Pair.
U.S. Appl. No. 14/570,746 Arnone, et al. filed Dec. 15, 2014

(56) References Cited

OTHER PUBLICATIONS (Applicant believes reference available to Examiner via Pair.
U.S. Appl. No. 14/570,857 Arnone, et al. filed Dec. 15, 2014
(Applicant believes reference available to Examiner via Pair.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 14/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
International Search Report and Written Opinion, PCT/US2013/48987, dated Dec. 16, 2013.

* cited by examiner

HYBRID GAME WITH MANUAL TRIGGER OPTION

CROSS-REFERENCE TO RELATED APPLICATIONS

This application is a continuation of PCT Application No. PCT/US13/48987, filed Jul. 1, 2013 which claims priority to U.S. Provisional Application No. 61/666,863, filed Jun. 30, 2012, the disclosure of each of which is incorporated by reference as if set forth herewith. The current application is also related to PCT Applications: PCT/US11/26768 filed Mar. 1, 2011 and PCT/US11/63587 filed Dec. 6, 2011, both of which are incorporated by reference as if set forth herewith. The current application is further related to U.S. Provisional Patent Applications: 61/459,131 filed Dec. 6, 2010; 61/460,362 filed Dec. 31, 2012; and 61/574,753 filed Aug. 9, 2011, all of which are incorporated by reference as if set forth herewith.

FIELD OF THE INVENTION

Embodiments of the present invention are generally related to gaming and more specifically to systems and processes that provide a gambling hybrid game where results of the gambling game affect conditions in an entertainment game.

BACKGROUND OF THE INVENTION

The gaming machine manufacturing industry provides a variety of gaming machines to enable wagering for interested parties whilst providing an entertainment experience. An exemplary gaming machine is a slot machine. As the demographic of eligible players has shifted with time to newer generations who have grown accustomed to highly sophisticated graphics and interactive video games, a need has arisen to increase the entertainment content present on a gaming machine to keep it relevant, at least to a growing portion of a casino's patronage. The subject design is a form of gaming machine, designed for use in a physical or virtual casino environment, which provides players an environment in which to play for cash, prizes and points, either against the casino or in head to head modes in a controlled and regulated manner while being allowed to use their skills and adeptness at a particular type of game. An example of such a game would be a challenging word spelling game, or an interactive action game such as is found on video game consoles popular today, such as a PlayStation®, an Xbox®, a Wii® or a PC based.

SUMMARY OF THE INVENTION

Systems and method for providing a gambling hybrid game with a manual trigger for gambling events on a computer device are disclosed. In accordance with embodiments of the invention, a gambling hybrid game has an entertainment engine that provides an entertainment game to a player; a game world engine that manages the entertainment game and a real world engine that resolves gambling event and manages real world credits of a player based on the results of the gambling events.

In accordance with embodiments of the invention, a manual triggering of gambling events in the gambling hybrid game is provided in the following manner. The game world engine provides a proposition on a gambling event to a user to the player. The entertainment engine receives a user input accepting the proposition. The entertainment engine provides the acceptance of the proposition to the game world engine. The game world engine requests a resolution of the gambling event associated with the proposition by a real world engine. The real world engine determines the results of the gambling event and provides the gambling event to the game world engine. The game world engine determines changes to a set of game variables based on the result of the gambling event and the proposition. The changes to the set of game variables are then provided by the game world engine to the entertainment engine. The entertainment engine then incorporates the changes in the set of game variables into the entertainment game using the entertainment engine.

In some embodiments, a player may make a gambling event request directly to the real world engine.

In accordance with some embodiments of the invention, the game world engine provides the gambling proposition at the beginning of play of the entertainment game and the gambling proposition sets initial conditions of the entertainment game based upon the results of the gambling event. The game world engine may also provide the gambling proposition based upon game play of the entertainment game reaching a particular juncture in accordance with some embodiments of the invention. In these embodiments, the gambling proposition changes the conditions of the game based upon the results of the gambling event.

In accordance with some embodiments of the invention, the entertainment game may be paused by the entertainment engine during the resolution of the gambling event.

In accordance with some embodiments of the invention, the changing of the set of game variables by the game world engine is based upon the result of the gambling event and an amount of real world credits wagered on the proposition by the user.

In accordance with some of the embodiments of the invention, the entertainment engine presents the updated game to the user and receives an input accepting or rejecting the updated game.

DETAILED DISCLOSURE OF THE INVENTION

Turning now to the drawings, a hybrid gaming system with a manual trigger system is provided in accordance with embodiments of the invention. In operation, the manual trigger system sets initial or interim conditions of an entertainment game as a function of player initiated/accepted gambling games, as well as the opportunity to rewind, fast forward, repeat, or otherwise "cheat" during conventional entertainment game play.

Gambling Hybrid Games

Figure 1:
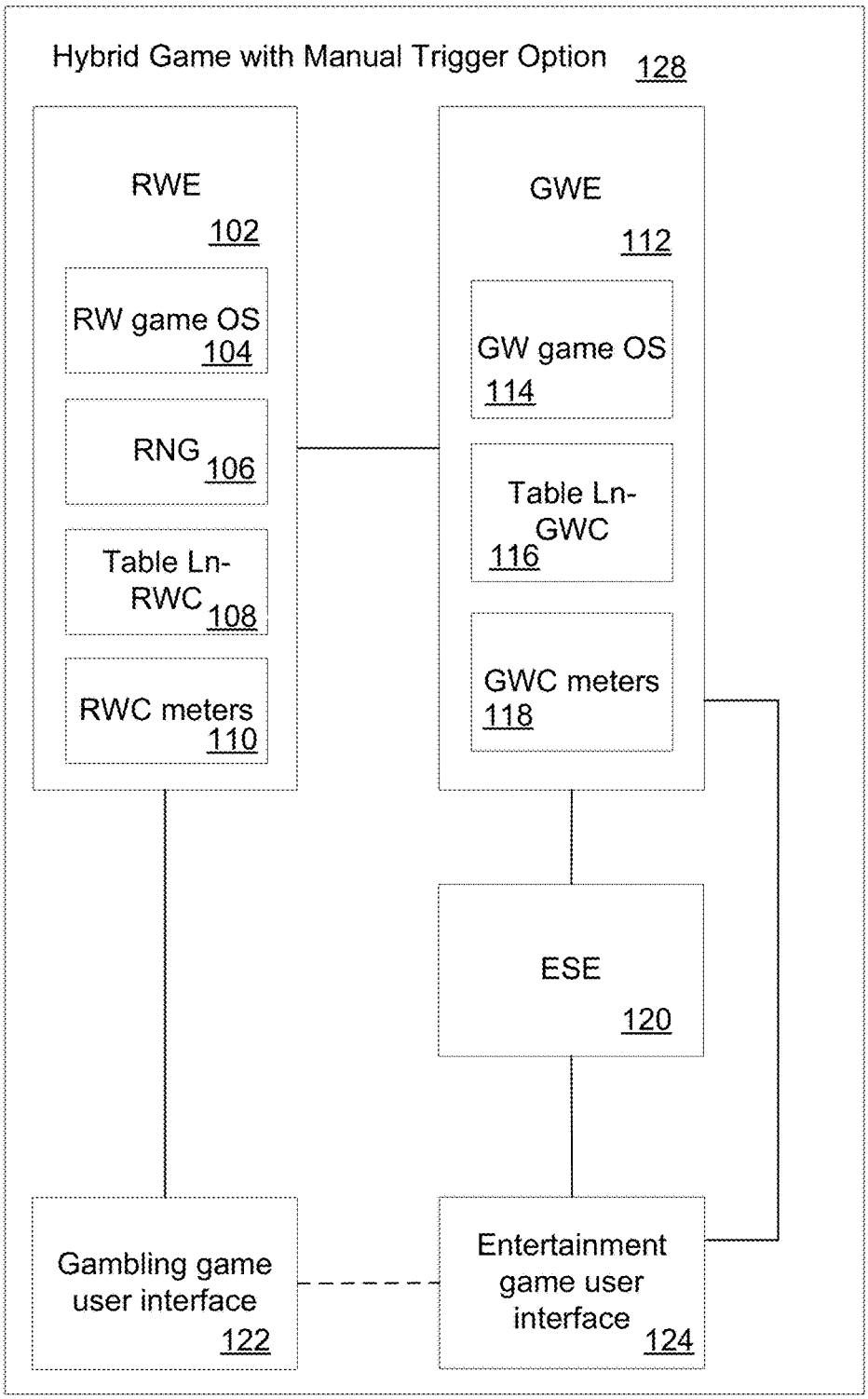
FIG. 1 illustrates a conceptual diagram of components of a gambling hybrid game in accordance with an embodiment of the invention.

In accordance with many embodiments of the invention, a gambling hybrid game integrates high-levels of entertainment content with a game of skill (entertainment game) and a gambling experience with a game of chance (gambling game). A gambling hybrid game provides for random outcomes independent of player skill while providing that the user's gaming experience (as measured by obstacles/challenges encountered, time of play and other factors) is shaped by the player's skill. The outcome of a gambling proposition that is determined by a Random Number Generator (RNG) or other such device that provides a random outcome in response to a request. In accordance with some embodiments, the wager game may be initiated in response to a game object related player action. A gambling hybrid game in accordance with an embodiment of the invention is illustrated in FIG. 1. The gambling hybrid game 128 includes a Real World Engine (RWE) 102, a Game World Engine (GWE) 112, an Entertainment System Engine (ESE) 120, a gambling game user interface 122 and an entertainment game user interface 124. The two user interfaces can be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124.

In accordance with several embodiments, the RWE 102 is the operating system for the gambling game of the gambling hybrid game 128 and controls and operates the gambling game. The operation of a gambling game is enabled by Real World Currency (RWC), such as money or other real world funds. A gambling game can increase or decrease an amount of RWC based on random gambling outcomes, where the gambling proposition of a gambling game is typically regulated by gaming control bodies. In many embodiments, the RWE includes a Real World (RW) operating system (OS) 104, RNG 106, level n real-world credit pay tables (table Ln-RWC) 108, RWC meters 110 and other software constructs that enable a game of chance to offer a fair and transparent gambling proposition, and to contain the auditable systems and functions that can enable the game to obtain gaming regulatory body approval.

A random number generator (RNG) 106 includes software and/or hardware algorithms and/or processes, which are used to generate random outcomes. A level n real-world credit pay table (table Ln-RWC) 108 is a table that can be used in conjunction with a random number generator (RNG) 106 to dictate the RWC earned as a function of sponsored gameplay and is analogous to the pay tables used in a conventional slot machine. Table Ln-RWC payouts are independent of player skill. There can be one table or multiple tables included in Ln-RWC pay tables 108 contained in a gambling game, the selection of which can be determined by factors including (but not limited to) game progress that a player has earned, and/or bonus rounds for which a player can be eligible. RWCs are credits analogous to slot machine game credits, which are entered into a gambling game by the user, either in the form of money such as hard currency or electronic funds. RWCs can be decremented or augmented based on the outcome of a random number generator according to the table Ln-RWC real world credits pay table 108, independent of player skill. In certain embodiments, an amount of RWC can be used as criteria in order to enter higher ESE game levels. RWC can be carried forward to higher game levels or paid out if a cash out is opted for by a player. The amount of RWC used to enter a specific level of the game level n need not be the same for each level.

In accordance with some embodiments of the invention, the GWE 112 manages the overall gambling hybrid game operation, with the RWE 102 and the ESE 120 effectively being support units to the GWE 112. In accordance with some of these embodiments, the GWE 112 contains mechanical, electronic, and software systems for an entertainment game. The GWE 112 includes an operating system (OS) 114 that provides control of the entertainment game. The GWE additionally contains a level n game world credit pay table (table Ln-GWC) 116 from where to take input from this table to affect the play of the entertainment game.

The GWE 112 can further couple to the RWE 102 to determine the amount of RWC available on the game and other metrics of wagering on the gambling game (and potentially affect the amount of RWC in play on the RWE). The GWE additionally contains various audit logs and activity meters (such as the GWC meter) 118. The GWE 112 can also couple to a centralized server for exchanging various data related to the player and their activities on the game. The GWE 112 furthermore couples to the ESE 120.

In accordance with some embodiments, a level n game world credit pay table (Table Ln-GWC) 116 dictates the Game World Credit (GWC) earned as a function of player skill in the nth level of the game. The payouts governed by this table are dependent upon player skill and sponsored gameplay at large and can or cannot be coupled to a RNG. In accordance with some embodiments, GWCs are player points earned or depleted as a function of player skill, specifically as a function of player performance in the context of the game. GWC is analogous to the score in a typical video game. Each entertainment game has one or more scoring criterion, embedded within the table Ln-GWC 116 that reflects player performance against the goal(s) of the game. GWCs can be carried forward from one level of sponsored gameplay to another, and ultimately paid out in various manners such as directly in cash, or indirectly such as by earning entrance into a sweepstakes drawing, or earning participation in, or victory in, a tournament with prizes. GWCs can be stored on a player tracking card or in a network-based player tracking system, where the GWCs are attributed to a specific player.

In accordance with certain embodiments, the operation of the GWE does not affect the RWE's gambling operation except for player choice parameters that are allowable in slot machines, including but not limited to, wager terms such as, but not limited to, a wager amount, how fast the player wants to play (by pressing a button or pulling the handle of a slot machine), and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RWC available in the gambling game. The communication link can also convey a status operation of the RWE (such as on-line or tilt). The communication link can further communicate the various gambling control factors which the RWE 102 uses as input, such as the number of RWC consumed per game or the player's election to enter a jackpot round. In FIG. 1, the GWE 112 is also shown as connecting to the player's user interface directly, as this can be utilized to communicate certain entertainment game club points, player status, control the selection of choices and messages which a player can find useful in order to adjust the entertainment game experience or understand their gambling status in the RWE 102.

In accordance with various embodiments of the invention, the ESE 120 manages and controls the visual, audio, and player control for the entertainment game. In accordance with certain embodiments, the ESE 120 accepts input from a player through a set of hand controls, and/or head, gesture, and/or eye tracking systems and outputs video, audio and/or other sensory output to a user interface. In accordance with many embodiments, the ESE 120 can exchange data with and accept control information from the GWE 112. In accordance with some of these embodiments, an ESE 120 can be implemented using a personal computer (PC), a Sony PlayStation® (a video game console developed by Sony Computer Entertainment of Tokyo Japan), or Microsoft Xbox® (a video game console developed by Microsoft Corporation of Redmond, Washington) running a specific entertainment game software program. In accordance with some of these embodiments, ESE 120 can be an electromechanical game system of a draw certificate based gambling hybrid game that is an electromechanical hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independently from the GWE 112, except that via the interface, the GWE 112 can send certain entertainment game control parameters and elements to the ESE 120 to affect its play, such as (but not limited to) what level of character to be using, changing the difficulty level of the game, changing the type of gun or car in use, and/or requesting potions to become available or to be found by the character. These game control parameters and elements can be based on a gambling outcome of a gambling game that was triggered by an element in the entertainment game being acted upon by the player. The ESE 120 can accept this input from the GWE 112, make adjustments, and continue entertainment game gameplay all the while running seamlessly from the player's perspective. The ESE's operation is mostly skill based, except for where the ESE's processes can inject complexities into the game by chance in its normal operation to create unpredictability in the entertainment game. Utilizing this interface, the ESE 120 can also communicate player choices made in the game to the GWE 112, such as but not limited to selection of a different gun, and/or the player picking up a special potion in the GW environment. The GWE's function in this architecture, being interfaced with the ESE 120, is to allow the transparent coupling of entertainment software to a fair and transparent random chance gambling game, providing a seamless perspective to the player that they are playing a typical popular entertainment game (which is skill based). In accordance with certain embodiments, the ESE 120 can be used to enable a wide range of entertainment games including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In accordance with some embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RWC in play, and amount of RWC available. The RWE 102 can accept modifications in the amount of RWC wagered on each individual gambling try, or the number of gambling games per minute the RWE 102 can execute, entrance into a bonus round, and other factors, all the while these factors can take a different form than that of a typical slot machine. An example of a varying wager amount that the player can choose can include, but is not limited to, gameplay with a more powerful character, a more powerful gun, or a better car. These choices can increase or decrease the amount wagered per individual gambling game, in the same manner that a standard slot machine player can decide to wager more or less credits for each pull of the handle. In accordance with some of these embodiments, the RWE 102 can communicate a number of factors back and forth to the GWE 112, via an interface, such increase/decrease in wager being a function of the player's decision making as to their operational profile in the entertainment game (such as but not limited to the power of the character, gun selection or car choice). In this manner, the player is always in control of the per game wager amount, with the choice mapping to some parameter or component that is applicable to the entertainment game experience of the hybrid game. In accordance with a particular embodiment, the RWE 102 operation can be a game of chance as a gambling game running every 10 seconds where the amount wagered is communicated from the GWE 112 as a function of choices the player makes in the operation profile in the entertainment game.

In many embodiments, a gambling hybrid game integrates a video game style gambling machine, where the gambling game (including an RWE 102 and RWC) is not player skill based, while at the same time allows players to use their skills to earn club points which a casino operator can translate to rewards, tournament opportunities and prizes for the players. The actual exchange of monetary funds earned or lost directly from gambling against a game of chance in a gambling game, such as a slot machine, is preserved. At the same time, a rich environment of rewards to stimulate gamers can be established with the entertainment game. In accordance with some of these embodiments, the gambling hybrid game can leverage very popular titles with gamers and provides a sea change environment for casinos to attract players with games that are more akin to the type of entertainment that a younger generation desires. In accordance with various embodiments, players can use their skill towards building and banking GWC that in turn can be used to win tournaments and various prizes as a function of their gamer prowess. Numerous embodiments minimize the underlying changes needed to the aforementioned entertainment software for the hybrid game to operate within an entertainment game construct, thus making a plethora of complex game titles and environments, rapid and inexpensive to deploy in a gambling environment.

In accordance with some embodiments, gambling hybrid games also allow players to gain entry into subsequent competitions through the accumulation of game world credits (GWC) as a function of the user's demonstrated skill at the game. These competitions can pit individual players or groups of players against one another and/or against the casino to win prizes based upon a combination of chance and skill. These competitions can be either asynchronous events, whereby players participate at a time and/or place of their choosing, or they can be synchronized events, whereby players participate at a specific time and/or venue.

In accordance with some embodiments, one or more players engage in playing an entertainment game, resident in the ESE, the outcomes of which are dependent at least in part on skill. The gambling hybrid game can include an entertainment game that includes head to head play between a single player and the computer, between two or more players against one another, or multiple players playing against the computer and/or each other, as well as the process by which players bet on the outcome of the entertainment game. The entertainment game can also be a game where the player is not playing against the computer or any other player, such as in games where the player is effectively playing against himself or herself (such as but not limited to Solitaire and Babette).

Figure 2:
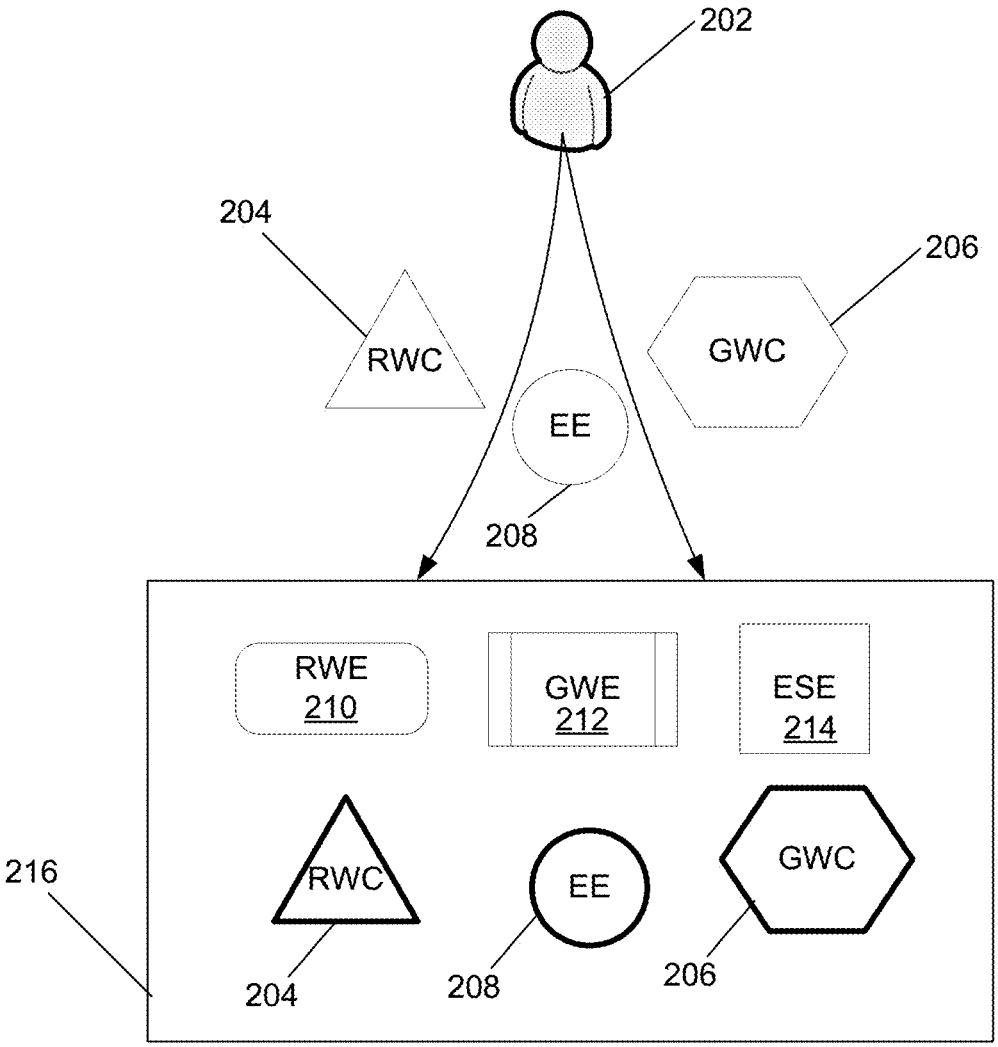
FIG. 2 is a system diagram that illustrates an implementation of a network distributed gambling hybrid game including a game world engine local server in accordance with an embodiment of the invention.

In accordance with some embodiments, a player can interact with a gambling hybrid game by using RWC in interactions with a gambling game along with GWC and elements in interactions with an entertainment game. The gambling game can be executed by a RWE while an entertainment game can be executed with an ESE and managed with a GWE. A conceptual diagram that illustrates how resources such as GWC, RWC and elements, such as but not limited to Entertainment Elements (EE), are utilized in a gambling hybrid game in accordance with an embodiment of the invention is illustrated in FIG. 2. The conceptual diagram illustrates that RWC 204, EE 208 and GWC 206 can be utilized by a player 202 in interactions with the RWE 210, GWE 212 and ESE 214 of a draw certificate based gambling hybrid game 216. The contribution of elements, such as EE 208, can be linked to a player's access to credits, such as RWC 204 or GWC 206. Electronic receipt of these credits can come via a smart card, voucher or other portable media, or as received over a network from a server. In accordance with certain embodiments, these credits can be drawn on demand from a player profile located in a database locally on a gambling hybrid game or in a remote server.

Figure 3:
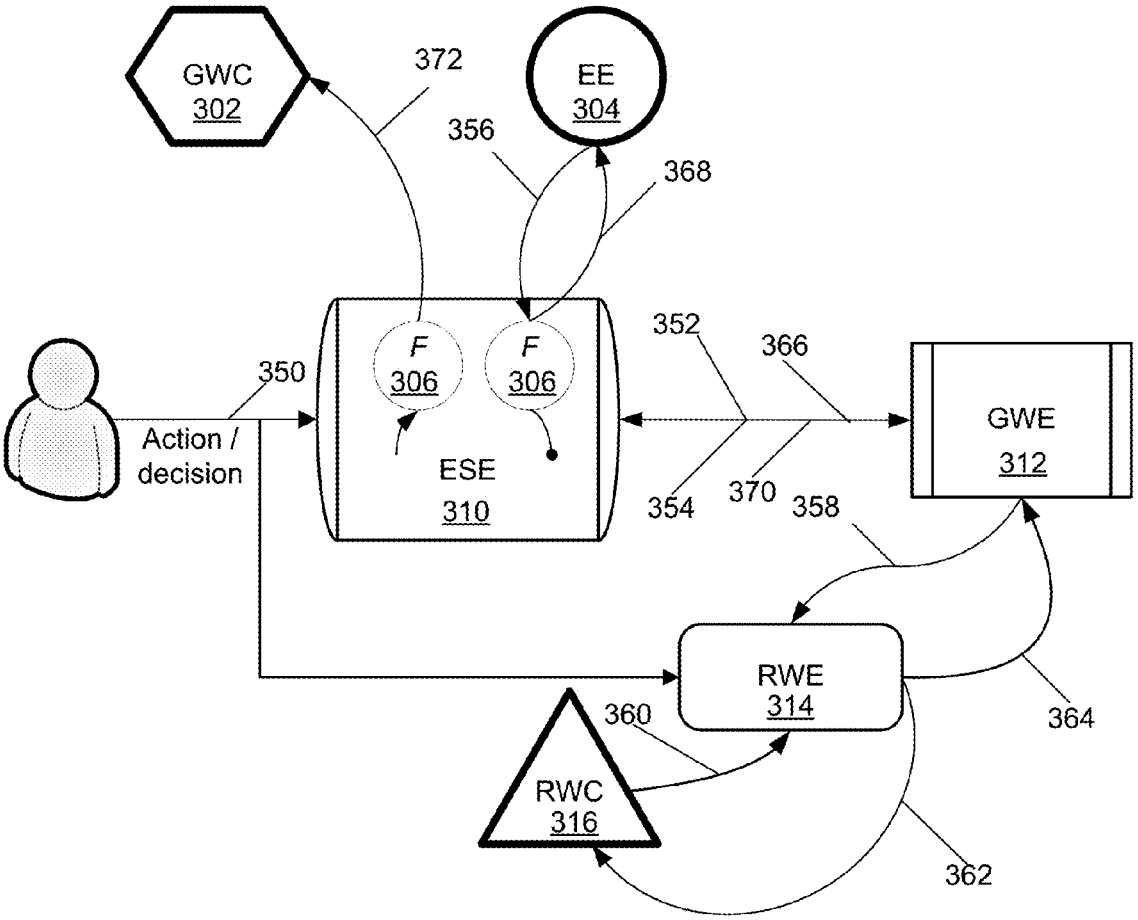
FIG. 3 illustrates a representative state diagram that illustrates an implementation of a network distributed gambling hybrid game in accordance with an embodiment of the invention.

A conceptual diagram that illustrates interplay between elements and components of a gambling hybrid game in accordance with an embodiment of the invention is illustrated in FIG. 3. Similar to FIG. 2, a player's actions and/or decisions can affect functions 306 that consume and/or accumulate GWC 302 and/or EE 304 in an entertainment game executed by an ESE 310. A GWE 312 can monitor the activities taking place within an entertainment game executed by an ESE 310 for gameplay gambling event occurrences. The GWE 312 can also communicate the gameplay gambling event occurrences to an RWE 314 that triggers a wager of RWC 316 in a gambling game executed by the RWE 314.

In accordance with some embodiments of the invention, the following may occur during use of the gambling hybrid game. The user enters an input that represents an action or decision (350). The ESE 310 signals the GWE 312 with the input decision or action (352). The GWE 312 responds by signaling to ESE 310 with the amount of EE that is consumed by the player action or decision (354). The signaling from the GWE 312 configures a function 306 to control the EE consumption, decay, and/or accumulation.

The ESE 310 then adjusts the EE 304 accordingly (356). The GWE 312 signals the RWE 314 as to the profile of the wager proposition associated with the action or decision and triggers the wager (358). The RWE 314 consumes the appropriate amount of RC 316 and executes the wager (360). The RWE 314 then adjusts the RC 316 based upon the outcome of the wager (362) and informs the GWE 312 as to the outcome of the wager (364).

The GWE 312 signals the ESE 310 to adjust EE to one or more of the EEs of the ESE entertainment game (366). Function 306 of the ESE 310 performs the adjustment of EE 304 (368). The ESE 310 signals the GWE 312 as to the updated status (370). In response, the GWE 312 signals the ESE 310 to update GWC of the entertainment game. The ESE updates the GWC using a function 306 (372).

The following is an example of the above flow in a first person shooter game, such a Call of Duty®, using a gambling hybrid game sequence in accordance with embodiments of the invention.

The process begins by a player selecting a machine gun to use in the game and then fires a burst of bullets at an opponent (350). The ESE 310 signals the GWE 312 of the player's choice of weapon, that a burst of bullets was fired, and the outcome of the burst (352). GWE 312 processes the information received and signals ESE 310 to consume 3 bullets (EE) with each pull of the trigger (354). The ESE 310 consumes 3 bullets for the burst using function 306 (356).

The GWE 312 signals the RWE 314 that 3 credits (RC) are to be wagered to match the three bullets consumed. The RWE 314 then obtains a draw certificate from a draw server or the like as discussed further below and determines the result of the wager and may determine the winnings from a pay table. On a particular pay table (Table Ln-RC), a determination is made by RWE 314 as to the amount of damage that the opponent has sustained. The RWE 314 consumes 3 credits of RC 316 for the wager and executes the specified wager (360). The RWE 314 determines that the player hit a jackpot of 6 credits and returns the 6 credits to the RC 316 (362) and signals the GWE 312 that 3 net credits were won by the player (364).

The GWE 312 signals ESE 310 to add 3 bullets to an ammunition clip (366). ESE 310 adds 3 bullets back to the ammo clip (EE 304) using a function 306 (368). The ammunition may be added by directly adding the ammunition to the clip or by allowing the user to find extra ammunition during game play. The GWE 312 logs the new player score (GWC 302) in the game (as a function of the successful hit on the opponent) based on the ESE 310 signaling, and the signals the ESE 310 to add 2 extra points to the player score since a jackpot has been won (370). The ESE 310 then adds 10 points to the player score (GWC 302) given the success of the hit which in this example is worth 8 points, plus the 2 extra points requested by GWE 312 (372). Note that the foregoing example is only intended to provide an illustration of how credits flow in a gambling hybrid game, but is not intended to be exhaustive and only lists only one of numerous possibilities of how a gambling hybrid game may be configured to manage its fundamental credits.

Network Based Gambling Hybrid Game

Figure 4:
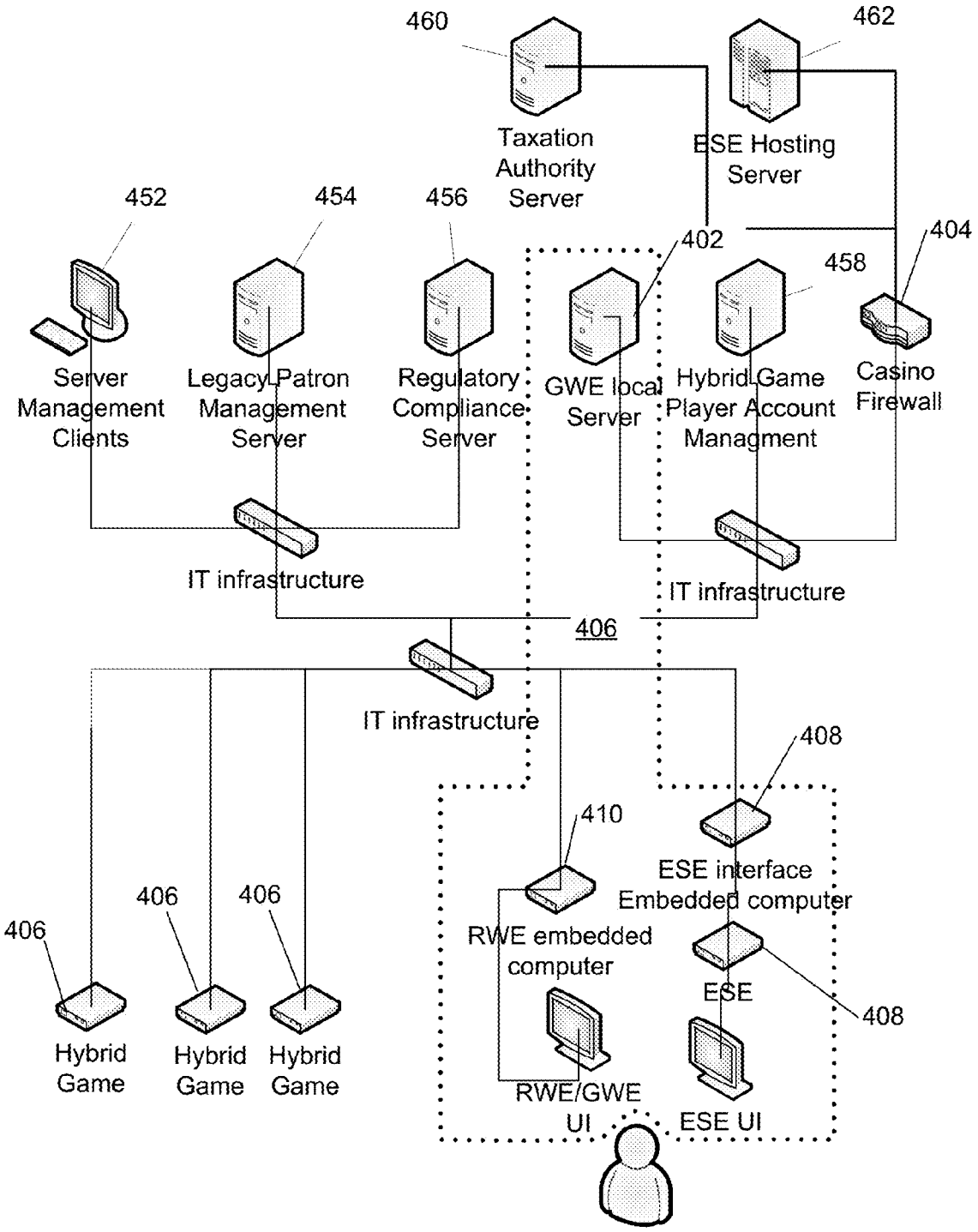
FIG. 4 illustrates a system diagram of an implementation of a network based gambling hybrid game in accordance with an embodiment of the invention.

A system diagram that illustrates an implementation of a network distributed gambling hybrid game with a GWE local server in accordance with embodiments of the invention is illustrated in FIG. 4. The system includes several gambling hybrid games 406 sharing services from the same GWE local server 402 over a network. The system includes several gambling hybrid games 406 sharing services from the same GWE local server 402 over a network. The gambling hybrid games 406 can be implemented on any device, including laptops, desktop computers, mobile phones, tablets or the like over a network connection. A single gambling hybrid game 406 with a RWE 410, ESE 408 and GWE 402 is enclosed within a dotted line. A number of other peripheral systems, such as, but not limited to, legacy patron management server 452, client management server 454, regulatory compliance server 456, and hybrid game player account management server 458 can also interface with the game object gambling hybrid games over a network within an operator's firewall 804. Other servers can reside outside the bounds of a network within an operator's firewall 404 to provide additional services for network connected game object gambling hybrid games. Examples of such servers, include, but are not limited to taxation authority server 460 and ESE hosting server 462. One skilled in the art will recognize that although these systems are represented as one server that one or more connected servers or other processing systems may provide the same function without departing from the invention.

Figure 5:
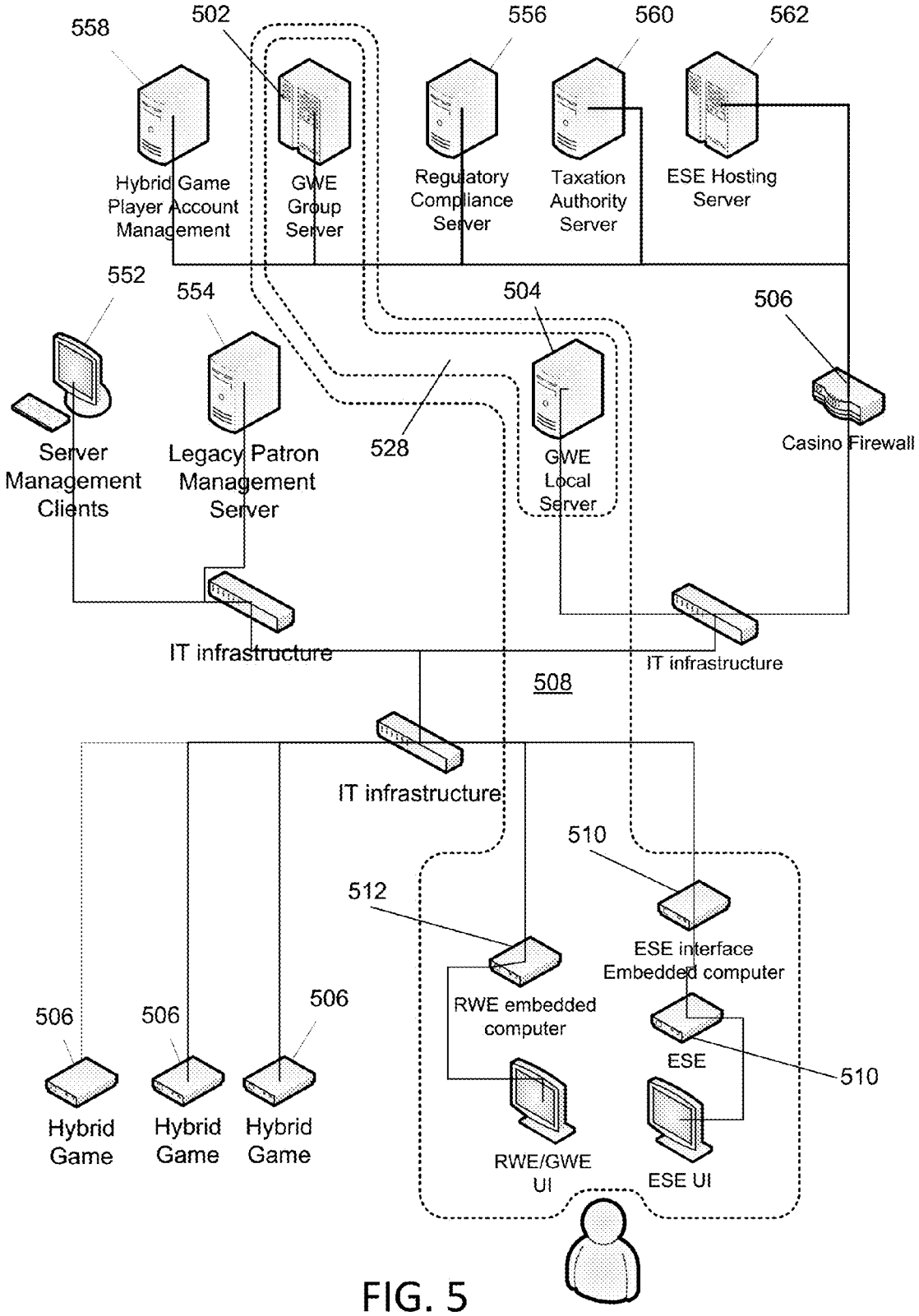
FIG. 5 illustrates a system diagram of an implementation of a network based gambling hybrid game in accordance with another embodiment of the invention.

A system diagram that illustrates an implementation of a network distributed hybrid game with a GWE local server and a GWE group server in accordance with embodiments of the invention is illustrated in FIG. 5. The system includes several gambling hybrid games 506 sharing services from the same GWE local server 528 over a network. The gambling hybrid games 506 can be implemented on any device, including laptops, desktop computers, mobile phones, tablets or the like over a network connection. A single gambling hybrid game 506 with a RWE 510, ESE 508 and GWE 528 is enclosed within a dotted line. This system includes a gambling hybrid game 508 that includes a RWE 512, ESE 510 and GWE local server 504 as shown enclosed within a dotted line but where a single gambling hybrid game can call upon services from servers within an operator's firewall 506 (such as, but not limited to, a GWE local server 504) as well as beyond an operator's firewall 506 (such as, but not limited to, a GWE group server 502). The GWE group server 502 can coordinate multiple gambling hybrid games from across a network that spans beyond an operator's firewall 506. A GWE server system 518 can include multiple GWE servers, such as, but not limited to, a GWE local server 504 and a GWE group server 502. Multiple network connected hybrid games 506 can be connected to various servers to call upon services that enable the execution of the hybrid game. These servers include but are not limited to client management server 552 and legacy patron management server 554 within the casino firewall 506; and regulatory compliance server 556, hybrid game account management server 558, taxation authority server 560 and ESE hosting server 562 outside the casino firewall 506. One skilled in the art will recognize that servers may be single servers or a group of servers and processing systems providing the services without departing from the invention; and that the servers described may be within or outside of casino firewall 506 without departing from the invention.

Figure 6:
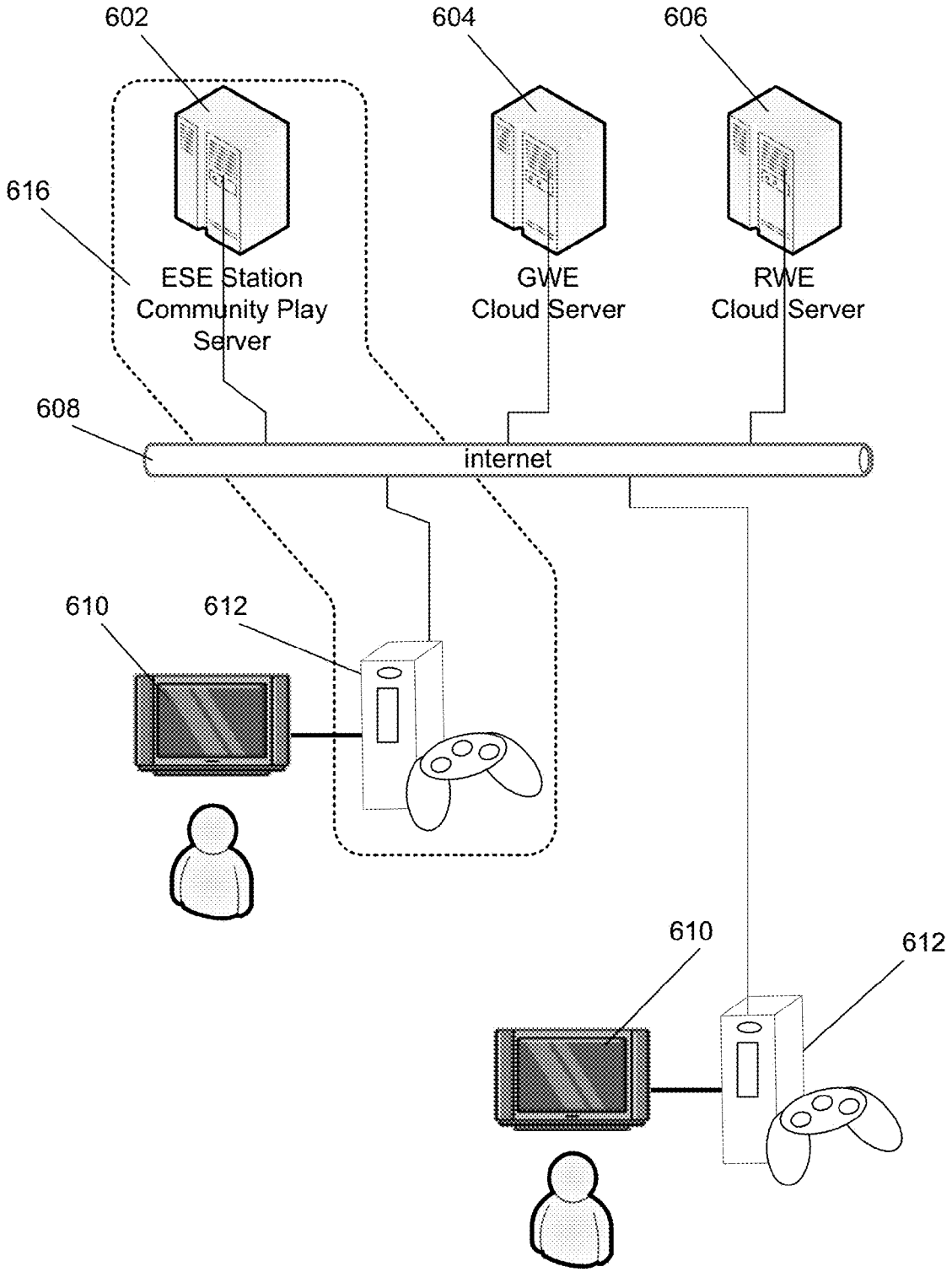
FIG. 6 illustrates a system diagram of an implementation of an Internet based gambling hybrid game in accordance with an embodiment of the invention.

A system diagram that illustrates an implementation of network distributed hybrid games over the Internet in accordance with an embodiment of the invention is illustrated in FIG. 6. The system includes an ESE server 602, GWE server 604 and RWE server 606 that each connect to a user interface 610 (such as, but not limited to, a television screen, computer terminal, tablet, touchscreen or PDA) of game object gambling hybrid games over the Internet 608. Each gambling hybrid game includes a local ESE 612 (such as, but not limited to, a video game console or a gaming computer system) that interfaces with a remote ESE server 602. Processes performed by an ESE 616 services can be performed in multiple locations, such as, but not limited to, remotely on an ESE server 602 and locally on a local ESE 612.

There are many possible permutations of the architecture of systems for providing a gambling hybrid game in accordance with embodiments of the invention. FIGS. 4-6 show only three possible permutations and are provided as examples which are not intended to suggest limitations to the forms of the architecture. Other permutations might include a version where the entire gambling hybrid game is in the cloud with only a client running on player terminal within the bounds of the casino, or a permutation where the RWE and GWE are casino bound and the ESE exists in the cloud, accessed by a client running on a terminal in the casino.

Processing Apparatuses

Figure 7:
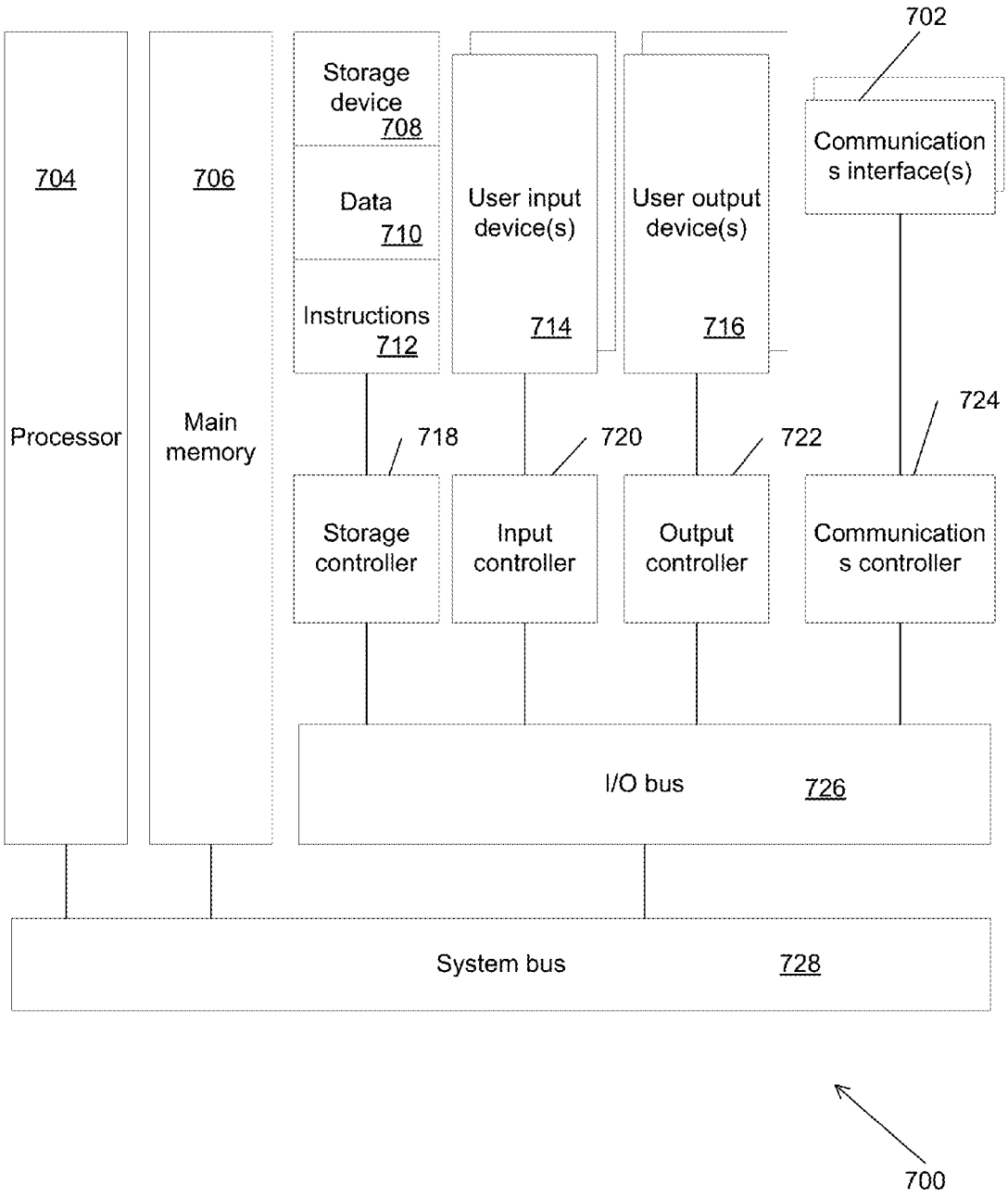
FIG. 7 illustrates a block diagram of components of a device implementing a gambling hybrid game in accordance with an embodiment of the invention.

Any of a variety of processing apparatuses can host various components of a gambling hybrid game in accordance with embodiments of the invention. In accordance with embodiments of the invention, these processing apparatuses can include, but are not limited to, a gaming machine, a general purpose computer, a computing device and/or a controller. A processing apparatus that is constructed to implement a gambling hybrid game in accordance with embodiments of the invention is illustrated in FIG. 7. In the processing apparatus 700, a processor 704 is coupled to a memory 706 by a bus 728. The processor 704 is also coupled to non-transitory processor-readable storage media, such as a storage device 708 that stores processor-executable instructions 712 and data 710 through the system bus 728 to an I/O bus 726 through a storage controller 718. The processor 704 is also coupled to one or more interfaces that can be used to connect the processor to other processing apparatuses as well as networks as described herein. The processor 704 is also coupled via the bus to user input devices 714, such as tactile devices including, but not limited to, keyboards, keypads, foot pads, touch screens, and/or trackballs; as well as non-contact devices such as audio input devices, motion sensors and motion capture devices that the processing apparatus can use to receive inputs from a user when the user interacts with the processing apparatus. The processor 704 is connected to these user input devices 714 through the system bus 728, to the I/O bus 726 and through the input controller 720. The processor 704 is also coupled via the bus to user output devices 716 such as (but not limited to) visual output devices, audio output devices, and/or tactile output devices that the processing apparatus uses to generate outputs perceivable by the user when the user interacts with the processing apparatus. In accordance with some embodiments, the processor is coupled to visual output devices such as (but not limited to) display screens, light panels, and/or lighted displays. In accordance with particular embodiments, the processor is coupled to audio output devices such as (but not limited to) speakers, and/or sound amplifiers. In accordance with many of these embodiments, the processor 704 is coupled to tactile output devices like vibrators, and/or manipulators. The processor 704 is connected to output devices from the system bus 728 to the I/O bus 726 and through the output controller 722. The processor 704 can also be connected to a communications interface 702 from the system bus 728 to the I/O bus 726 through a communications controller 724.

In accordance with various embodiments, a processor 704 can load instructions and data from the storage device into the memory 706. The processor 704 can also execute instructions that operate on the data to implement various aspects and features of the components of a gambling hybrid game. The processor 704 can utilize various input and output devices in accordance with the instructions and the data in order to create and operate user interfaces for players or operators of a gambling hybrid game(such as but not limited to a casino that hosts the gambling hybrid game).

Although the processing apparatus 700 is described herein as being constructed from a processor and instructions stored and executed by hardware components, the processing apparatus can be composed of only hardware components in accordance with other embodiments. In addition, although the storage device is described as being coupled to the processor through a bus, those skilled in the art of processing apparatuses will understand that the storage device can include removable media such as, but not limited to, a USB memory device, an optical CD ROM, magnetic media such as tape and disks. Also, the storage device can be accessed by processor 704 through one of the interfaces or over a network. Furthermore, any of the user input devices or user output devices can be coupled to the processor 704 via one of the interfaces or over a network. In addition, although a single processor 704 is described, those skilled in the art will understand that the processor 704 can be a controller or other computing device or a separate computer as well as be composed of multiple processors or computing devices.

Gambling Hybrid Game Having Manual Triggers of a Gambling Events

Figure 8:
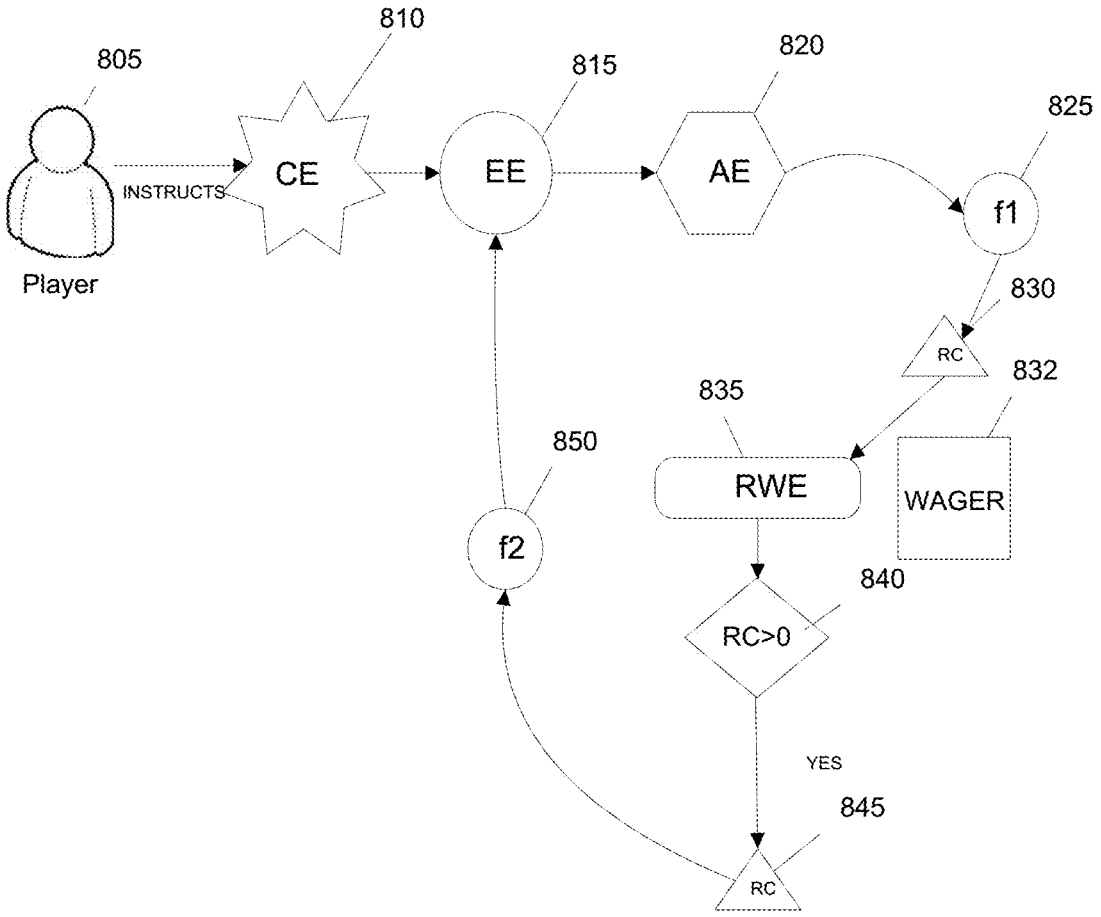
FIG. 8 illustrates a conceptual diagram of a single player interacting with a gambling hybrid game in accordance with embodiments of the invention.

In accordance with embodiments of the invention, a gambling hybrid game allows a player to make wagers on propositions of a gambling event that occurs during play of an entertainment game. A conceptual diagram of operation of a gambling hybrid game interacting with a single player and providing a gambling event in accordance with embodiments of the invention is shown in FIG. 8. In FIG. 8, a player 805 enters an input directing a controllable element 810 in an entertainment game. An Entertainment Engine (EE) 815 receives the instruction and determines the proper Action Event (AE) 820 that is requested by the instructions. For purposes of this discussion is an AE is an event that is caused by the instruction and may include, but is not limited to, a character performing a specific action; or a modification of the inventory of the character or another game element. The action event 820 is provided to a function 825, f1 that determines whether the AE triggers a gambling event. A gambling event is an event that includes probabilities that a certain outcome will result. A proposition of a gambling event is a bet that a certain outcome will occur. A wager then is an amount based on a payout of the proposition as to whether or not the outcome will occur. The gambling event includes a wager 832 of Real World Credits (RWC or RC) 830. The wager may be input by the user or be based upon the gambling event occurring. The RWE 835 is informed of the gambling event and determines the outcome 845 of the gambling event and the wager (840). The outcome of the gambling event is provided to a function 850 f2. The f2 850 incorporates the results into game play parameters and provides the game play parameters to EE 815 for incorporation into the entertainment game. Other aspects and embodiments disclosed previously are incorporated by reference herein. For the purposes of this disclosure, this construct will represent the base case of a player that is engaged in single-player play against himself, time, a computer opponent, etc.

In accordance with many embodiments of the invention, the gambling hybrid game includes a manual trigger system. In operation, the manual trigger system sets initial or interim conditions of an entertainment game as a function of player initiated/accepted gambling games, as well as the opportunity to rewind, fast forward, repeat, or otherwise "cheat" or obtain some advantage during conventional entertainment game play. In accordance with some of these embodiments, the gambling hybrid game may commence with the player undertaking a gambling game to set initial conditions for the entertainment game portion of the Hybrid Game. The gambling game may be a single gambling event or a set of gambling events that are all part of the same gambling game. The player selects a gambling proposition (or a singular gambling proposition is offered), and the results of the gambling events during the gambling game cause a change to the player's RC, and also results in the communication of information about the gambling game (e.g. amount gambled, pay table in use, result of gambling game) to the GWE, which then uses that information to either select a specific initial condition for the entertainment game, or to set a variable that is then in turn communicated to the ESE by which the ESE establishes (in whole or in part) the initial conditions for the entertainment game portion of the Hybrid Game. A process of providing a manual trigger for a gambling hybrid game to set the initial conditions of the entertainment game in accordance with embodiments of the invention are shown in FIG. 9.

Figure 9:
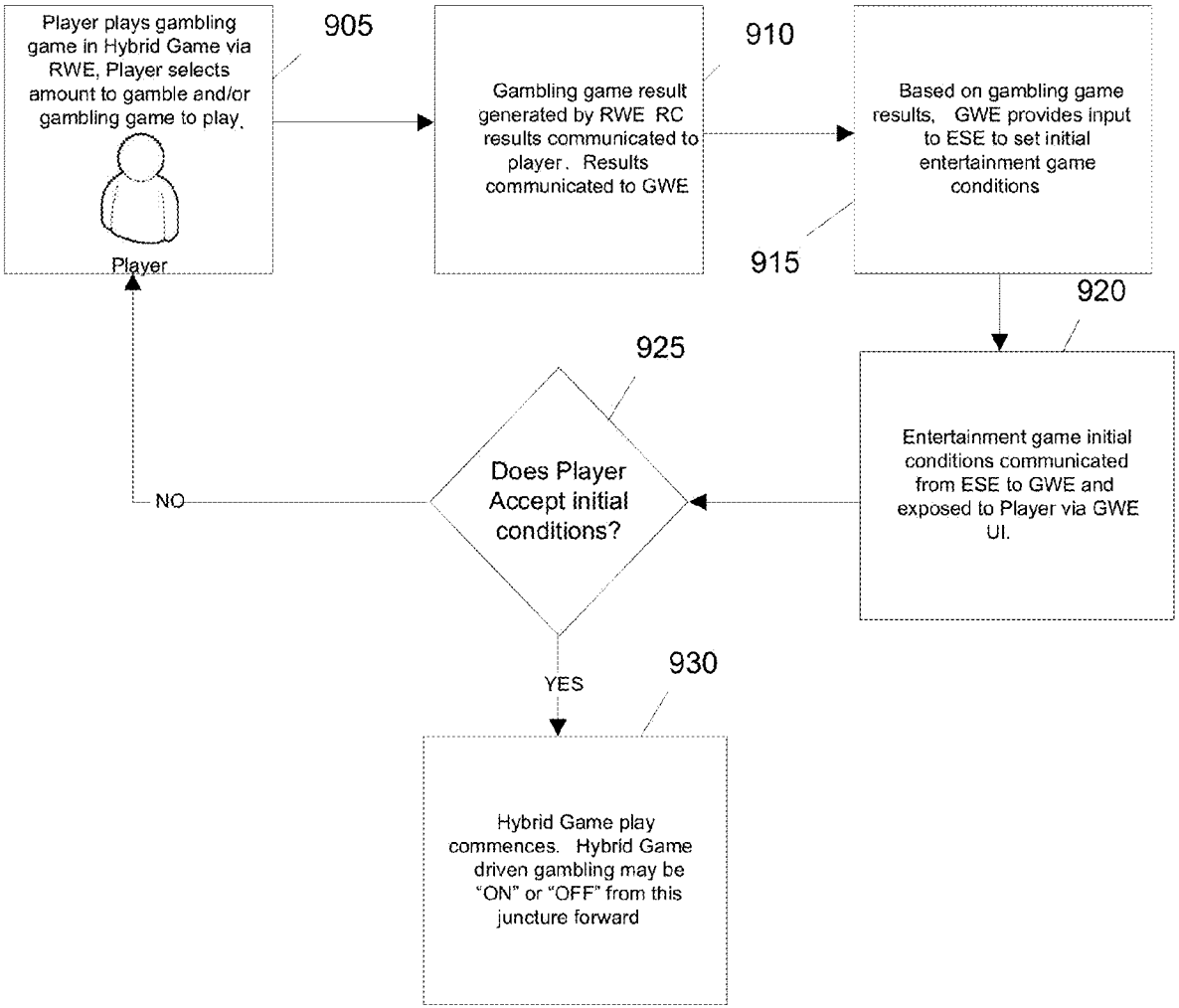
FIG. 9 illustrates a conceptual diagram of the interaction between components for a system providing a gambling hybrid game with a manual trigger at the initiation of an entertainment game in accordance with other embodiments of the invention.

In the process shown in FIG. 9, the player plays a gambling game via the RWE (905). In accordance with some embodiments of the invention, the player is not required to play the gambling game at the onset to set initial conditions, but is offered this opportunity as a means to at a minimum maintain, but possibly to improve, the game's initial conditions. The player elect or decline to participate in the gambling game. In accordance with some embodiments of the invention, the player may accept initial conditions without playing the gambling game, or may play a gambling game that may improve, degrade, or maintain the initial conditions presented to the player before the player decides whether to play the gambling game.

In playing the gambling game, the player interacts with the RWE to select the gambling game to play and to place wages on gambling events in the gambling game. The RWE determines the results of the gambling events in the gambling game and communicates the results to the player and the GWE (910). Based on the results from the gambling events in the gambling game, the GWE provides inputs to the ESE to set initial conditions for the entertainment game (915). The setting of the initial conditions of the entertainment game can be set entirely as a function of the gambling, or in part, i.e. other factors. Examples of other factors include, but are not limited to, player account information, casino preferences, and time of day. In accordance with some embodiments, the GWE may contain a component that provides game or ESE specific data. This component may contain algorithms that translate RWE gambling event results into entertainment game outcomes. Alternatively, the GWE may send gambling event outcome data to the ESE which then generates the requisite game state.

The ESE sets the initial conditions and communicates these initial conditions to the GWE and provides the initial conditions to the player (920). For example, this process could lead to the selection of the computer operated boxer in a boxing game. In particular, a RWE win might lead to a weaker opponent or one better suited (from the player's perspective) to the nature of his boxing agent, in a gambling hybrid game. A RWE loss might lead to a strong opponent with a style that is difficult for the player's boxing agent to defend against. In a first person shooter game, it could dictate where in the virtual world the player's character starts play, and/or the number and strength of the enemy combatants in the field of play. Alternately, it could affect the weapon type or properties of the weapons available to the player (i.e. weapon accuracy, range, firing speed, propensity to jam, etc.). In accordance with some embodiments, the initialization of the entertainment game also affects the player's prospect of acquiring GWC (i.e. a more difficult initialization state can have the prospect of greater GWC accumulation than a less difficult initialization state). The relative difficulty, and by extension potential for GWC accumulation, may or may not be explicitly communicated to the player.

The player may then communicate with ESE to accept the conditions (925). If the conditions are not accepted, the player may return to the gambling game (905) to repeat the gambling game in order to try to obtain better initial conditions. In accordance with some embodiments of the invention, the initialization process takes place between 1 and N times (i.e. it is conceived that there may be a limit to the number of initializations that are permitted), after which, to continue play the player must engage with the gambling hybrid game via the entertainment game, rather than continuing to gamble and reset initial conditions over and over.

If the initial conditions are accepted, the gambling hybrid game commences to allow the player to play the entertainment game portion of the gambling hybrid game (930). In accordance with some embodiments of the invention, the gambling hybrid game continues in accordance with normal operations In accordance with other embodiments, the gambling hybrid game continues from this point in the gambling hybrid game with no further gambling game aspects (e.g. the consumption of EE does not trigger a gambling game). In accordance with still other embodiments, the gambling hybrid game does include the ongoing triggering of gambling games as a function of (for example) EE, AE, and/or CEE consumption. The following is an example of the operation of a gambling hybrid game providing a gambling game to set initial conditions in accordance with embodiments of the invention shown in FIG. 9. In Scrabble, the process affects which seven tiles that the player has on his rack to start the game. The process could also set the tiles that the computer has on its rack. First, the player selects an amount to gamble and/or gambling game to play in a Scrabble hybrid game. The player initiates the gambling event (905). The initiation may be performed by the player performing an action or making a decision through the GWE UI. The RWE signals the GWE of the results of the gambling events during the gambling game (910). The portion of the GWE specific to Scrabble and the ESE use the information about the results to determine an input to change the initial conditions of the game and provide the input to the ESE to determine the initial conditions applicable to a wagering win (915). The ESE uses the input to control aspect of EE use including (but not limited to) EE consumption, decay and/or addition. (920). In this example, the ESE entertainment game selects seven tiles that potentially form a high number of words when placed on the Scrabble board. The selected tiles are then displayed to the player. The player views the seven tiles received from the gambling outcome and decides whether to keep the seven tiles initially drawn.

In the case where the player rejects the seven tiles and places another wager, the process is repeated. In the case where the player accepts the seven tiles, the gambling hybrid gameplay commences (930).

In accordance with other embodiments of the invention, the gambling hybrid game has a manual trigger process during play of the entertainment game. The manual trigger during entertainment game play may occur in the following manner. The player is playing a gambling hybrid game in the conventional manner (e.g. consumption of EE in entertainment game triggers gambling game, which in turn may augment EE and RC, etc.). At various junctures during play of the entertainment game, the player is either required or provided the option to play a gambling game for the purpose of configuring go-forward conditions of the entertainment game. This is similar to the aspect where the player gambles to set initial conditions as described above with reference to FIG. 9. However, the process takes place mid-stream or during game play of the entertainment game. For example, the manual trigger may take place between rounds of a boxing game, immediately prior to drawing letters from "the bag" in Scrabble at the conclusion of each turn, or before advancing to the next level in a Pac-man game, etc. A process for providing a manual trigger during a gambling hybrid game during game play in accordance with embodiments of the invention is shown FIG. 10.

Figure 10:
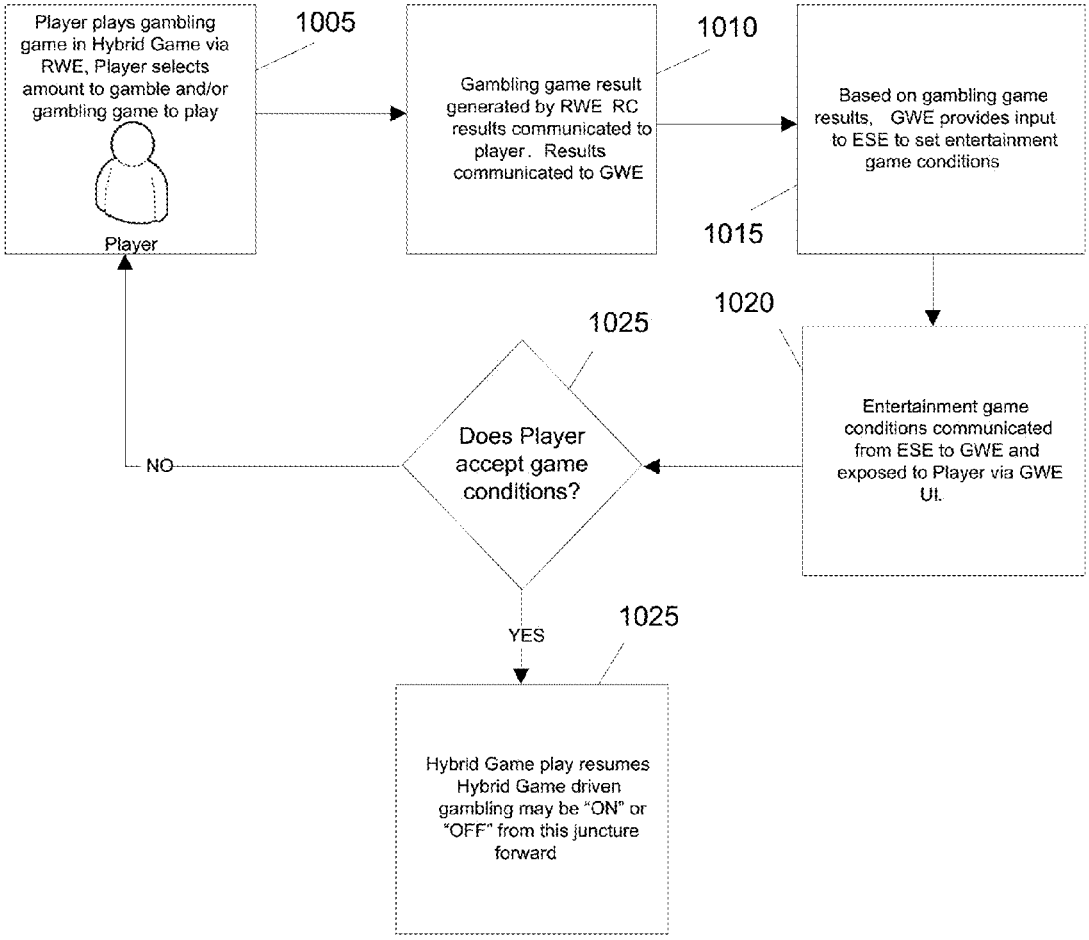
FIG. 10 illustrates a conceptual diagram of the interaction between components for a system providing a gambling hybrid game having a manual trigger during play of an entertainment game that provides a gambling game to change the conditions in the entertainment game during game play of entertainment game in accordance with embodiments of the invention.

In the process shown in FIG. 10. The process begins when gameplay in an entertainment game reaches a specific juncture and the player begins to play a gambling game via the RWE (1005). In accordance with some embodiments, the entertainment game conditions affected by the gambling game can be specific in-entertainment game conditions not related to a specific juncture or "break point" (e.g. advancing from one level to another). For example, a player in an adventure game may approach a chest. The player is required to gamble 1 RC to establish the contents of the chest. If the gambling game is lost the chest is empty (or contains less valuable contents). If the gambling game is won, the chest contains valuable contents, the amount of said value (in entertainment game terms) being a function at least in part of the result of the gambling game. In accordance with some of these embodiments, the player may input how much money to gamble at this juncture, thereby potentially increasing the contents of the chest (e.g. if the player gambles 1 RC and wins 2 RC the contents of the chest is 200 gold pieces, while if the player gambles 10 RC and wins 20 RC the contents of the chest is 2000 gold pieces). In accordance with some embodiments of the invention, the player is not required to play a gambling game for the purpose of configuring go-forward conditions of the entertainment game, but is given this option, which may provide the prospect of improving and/or degrading go-forward conditions relative to the configuration the player will experience if the gambling game is not played. In accordance with some embodiments, the player may indicate game condition preferences in advance or during play. For example, a player may prefer a more challenging opponent, or a specific battlefield type. These preferences may be indicated through the Host Mode, saved in a player profile, updated throughout the game or in another fashion. A successful gambling result may generate the player's preferred game state rather than a standard game state.

The notification of the requirement, or option, to play the gambling game described above can be made through numerous means, including a distinct interruption to the graphical flow of the entertainment game (i.e. the game is paused while the gambling proposition is presented, accepted, and undertaken). Alternatively, the notification may be integrated into the entertainment game (i.e. in a battle strategy game, the player may be notified that different missions are available, and a gambling event may be used to determine which mission is used).

The process continues in a similar manner as the process described with respect to FIG. 9. Referring back to FIG. 10, the player interacts with the RWE to select the gambling game to play and to place wages on gambling events in the gambling game. The RWE determines the results of the gambling events in the gambling game and communicates the results to the player and the GWE (1010). Based on the results from the gambling events in the gambling game, the GWE provides inputs to the ESE to set current conditions for the entertainment game (1015). The setting of the current conditions of the entertainment game can be set entirely as a function of the gambling, or in part, i.e. other factors. Examples of other factors include, but are not limited to, player account information, casino preferences, and time of day. In accordance with some embodiments, the GWE may contain a component that provides game or ESE specific data. This component may contain algorithms that translate RWE gambling event results into entertainment game outcomes. Alternatively, the GWE may send gambling event outcome data to the ESE which then generates the requisite game state. The ESE sets the initial conditions and communicates these initial conditions to the GWE and provides the initial conditions to the player (1020). The player then may select to continue playing the gambling game to get a better set of current conditions or may proceed with playing the hybrid gambling game (1025).

Figure 11:
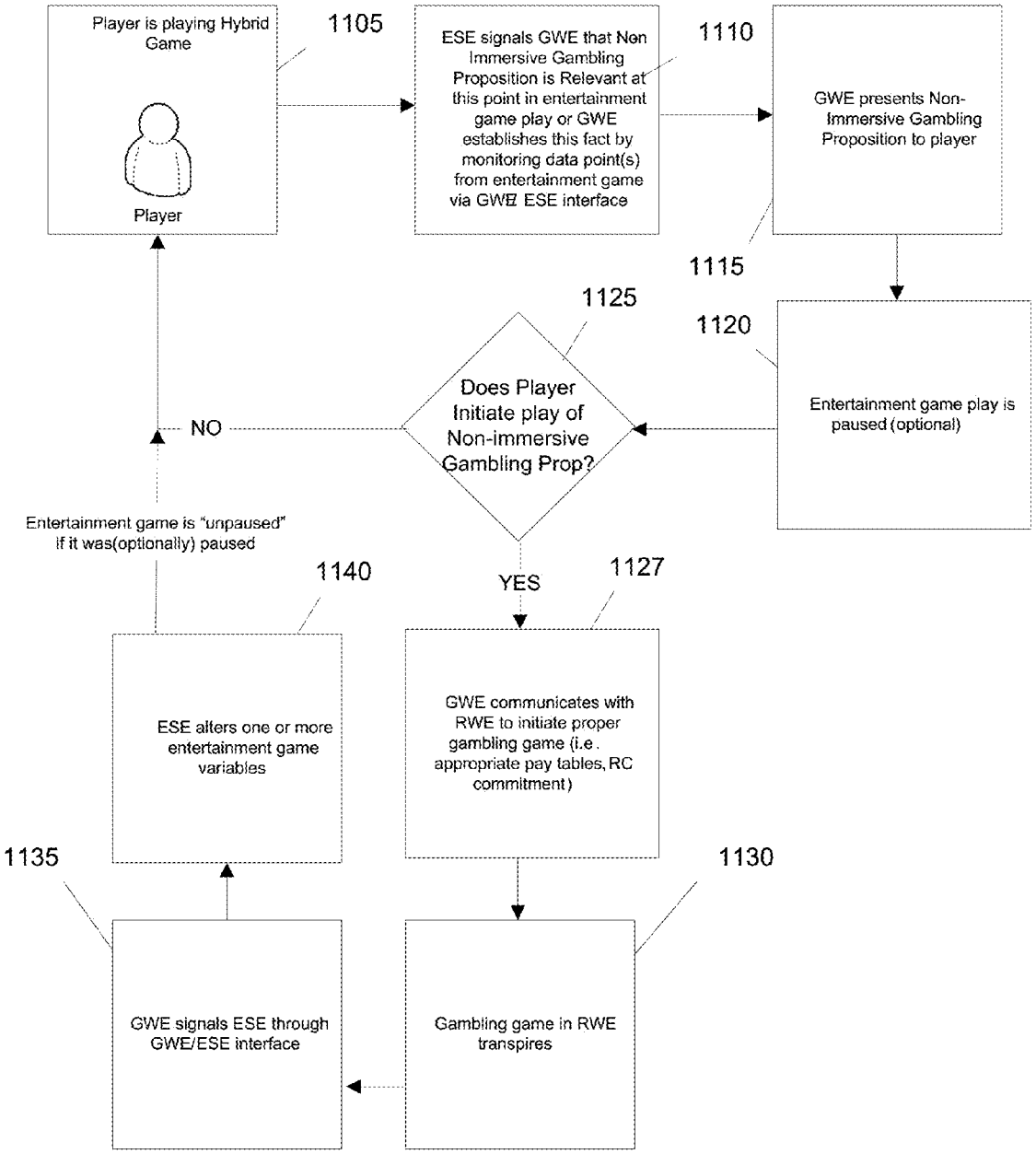
FIG. 11 illustrates a conceptual diagram of the interaction between components for a system providing a gambling hybrid game having a manual trigger during play of an entertainment game that provides a gambling game to change the conditions in the entertainment game during game play of entertainment game in accordance with other embodiments of the invention

A more detailed process for providing a manual trigger during a gambling hybrid game during game play in accordance with embodiments of the invention is shown in FIG. 11. The previous example of the contents of a chest applies here. Another example may be seen in a boxing game. The player's boxer in the game is knocked to the mat. The player is required to play a gambling game at that time, the result of which directly affects whether or not the player's CE (the boxer) is KO'd or not. This "loop" is independent of the initiation of gambling in the Hybrid Game as a result of EE, AE, CEE consumption, etc. and can exist in conjunction with or in lieu of.

In the process shown in FIG. 11, the player is playing an entertainment game within a gambling hybrid game (1105). In response to a particular event in the entertainment game, the ESE signals the GWE that a non-immersive gambling proposition is relevant (1110). Alternatively, the GWE may determine the non-immersive gambling proposition is relevant from monitored data points in the entertainment game. The GWE presents the proposition of the gambling game to the player (1115). The ESE may optionally pause game play of the entertainment game during the gambling game (1120). The player then either accepts or declines the proposition (1125). If the proposition is rejected, game play of the entertainment game of the gambling hybrid game continues (1105). If the proposition is accepted, the GWE communicates with the RWE to initiate the proper gambling game (1127). Gambling events of the gambling game are then resolved by the RWE (1130). The results of the gambling events in the gambling game are then provided by the RWE to GWE. The GWE then determines inputs to the entertainment game based upon the results of the gambling events. The inputs are then provided by the GWE to the ESE (1135). The ESE uses the inputs to alter one of more entertainment game variables to update the game conditions (1140).

Figure 12:
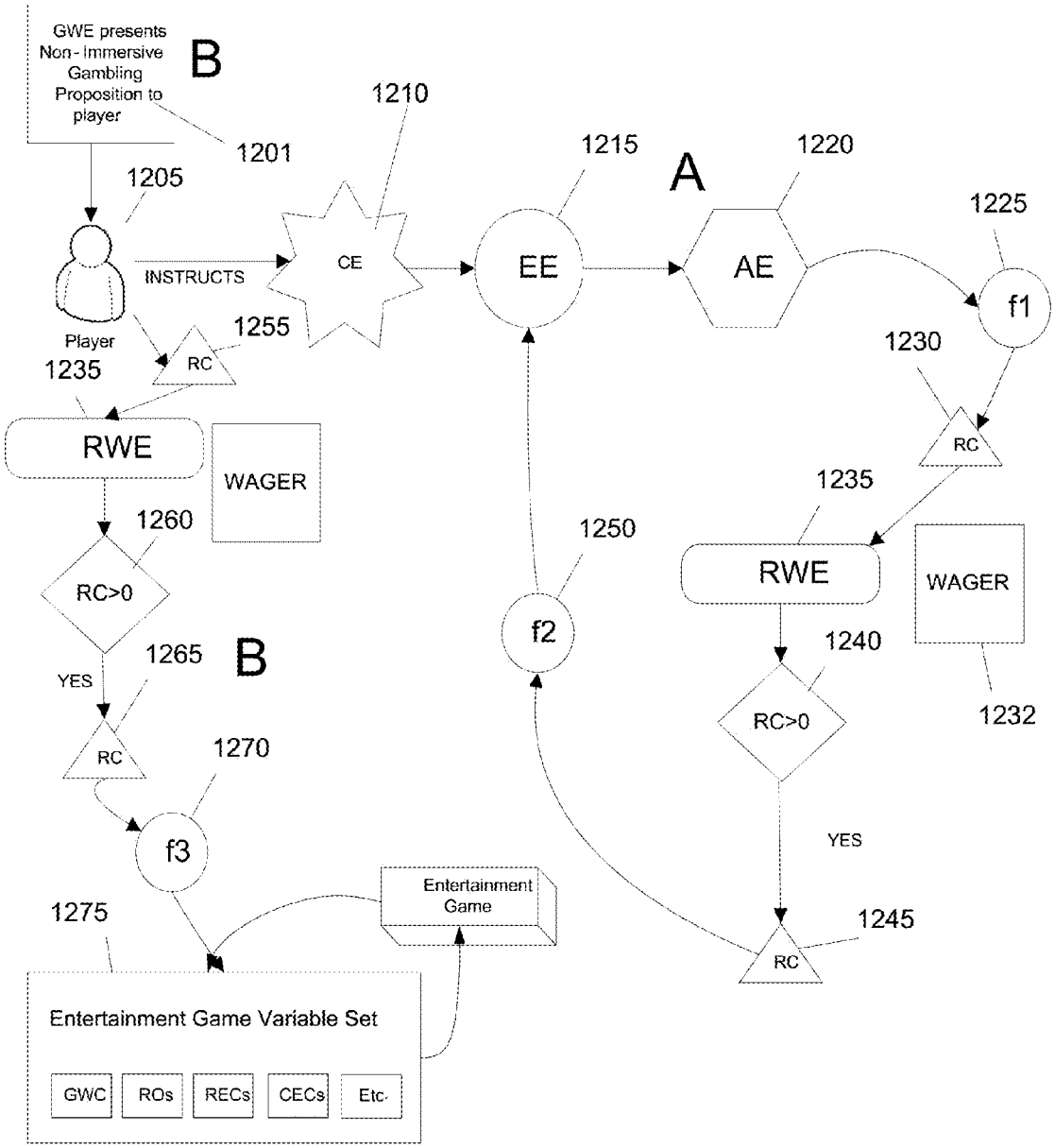
FIG. 12 illustrates a conceptual diagram of the interaction between components for a system providing a gambling hybrid game showing both a conventional hybrid game and a gambling game initiated by a manual trigger in accordance with embodiments of the invention.

In accordance with embodiments of the invention, a gambling hybrid game provides a non-immersive gambling proposition or manual trigger. A non-immersive gambling proposition (or manual trigger) is differentiated from a conventional (or immersive) gambling hybrid game that includes embedded gambling. In the latter, the gambling is initiated by conventional, in-game actions associated with entertainment game play. In the former case, the player is flagged to evaluate and potentially participate in a gambling proposition. The gambling proposition or manual trigger still provides a closed loop to the entertainment game, but operates outside conventional entertainment game play. A comparison of the steps for providing non-immersive (manual trigger) and immersive gambling events in accordance with embodiments of the invention is shown in FIG. 12.

The immersive or conventional manner is represented by process A. In process A, a player 1205 enters an input directing a controllable element 1210 in an entertainment game. An Entertainment Engine (EE) 1215 receives the instruction and determines the proper Action Event (AE) 1220 that is requested by the instructions. For purposes of this discussion, an AE is an event that is caused by the instruction and may include, but is not limited to, a character performing a specific action; or a modification of the inventory of the character or another game element. The action event 1220 is provided to a function (f1)1225 that determines that the AE triggers a gambling event. A gambling event is an event that includes probabilities that a certain outcome will result. A proposition of a gambling event is a bet that a certain outcome will occur. A wager then is an amount based on a payout of the proposition as to whether or not the outcome will occur. The gambling event includes a wager 1232 of Real World Credits (RWC or RC) 1230. The wager may be input by the user or be based upon the gambling event occurring. The RWE 1235 is informed of the gambling event and determines the outcome 1245 of the gambling event and the wager (1240). The outcome of the gambling event is provided to a function 850 f2. The f2 1250 incorporates the results into game play parameters and provides the game play parameters to EE 1215 for incorporation into the entertainment game In the non-immersive propositions or manual trigger, the GWE presents a non-immersive gambling proposition to the player (1201). The player accepts the proposition and places an RC wager (1255) on the gambling proposition. The RWE 1235 receives the relevant information from the GWE and determines the result of the gambling event (1260). The results of the gambling event that may include RC winning 1265 are communicated to function (f3) 1270 in the GWE. The function f3 1270 determines an input that modifies variables in an entertainment game variable set 1275 and provides the input to the ESE for incorporation into the entertainment game.

In accordance with some embodiments of the invention, the non-immersive gambling proposition can also take the form of a "cheat" relative to the entertainment game, such that the player can play the gambling game in the hopes of advantaging himself relative to the entertainment game context of the gambling hybrid game. The following are non-limiting examples of non-immersive gambling propositions in accordance with embodiments of the invention. In a gambling hybrid game implementation of Plants v. Zombies if the Zombie is about to enter the house and "eat the player's brains", the player can be presented with a gambling game proposition by which, if he wins, game play can continue and the zombie is "evaporated" rather than entering the home. In a gambling hybrid game implementation of Battleship, if a player does not score a "hit" on an enemy ship during a turn, the player may be offered a gambling proposition, which if won, will permit the player to re-select placement of that peg. In a Hybrid Game implementation of DOOM, when the player's character is killed, the player may be offered a gambling proposition, which if won will advance the player past the current point of the game and reinstate that character's life or may reinstate the character's life but place the character back one minute in game time (i.e. in a state prior to the death of the character) or at some other point within the game appropriate to a specific application. In a gambling hybrid game implementation of Modern Warfare, the player may be presented with a gambling proposition, which if won will kill all enemies within a 1 km radius of the player's CE in the game world. This may also include the awarding of GWC as if the player had "conventionally" killed all these enemies, or it may include an enhancement or attenuation of the amount of GWC that would have been awarded for such a feat absent the impact of the gambling game.

Figure 13:
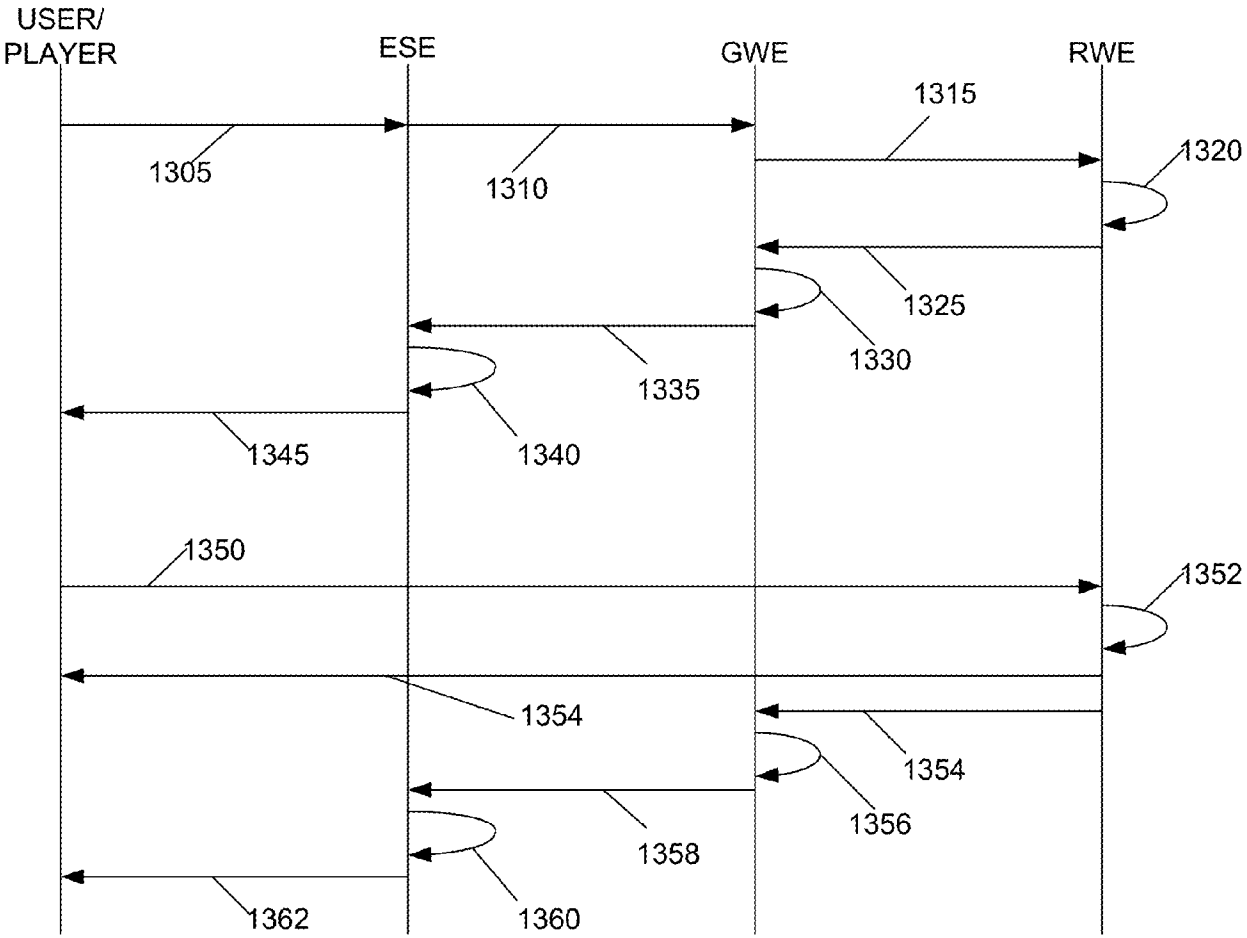
FIG. 13 illustrates a timing diagram of information passed between components of a system providing a gambling hybrid game having a manual trigger of a gambling event in accordance with embodiments of the invention.

Manual Trigger of a Non-Immersive Gambling Proposition in a Gambling Hybrid Game A system that provides a gambling hybrid game including manual triggering of gambling events in accordance with embodiments of the invention is shown in FIGS. 13-16. A timing diagram of the information passed between various components of the gambling hybrid game to provide a manual trigger of a gambling event is shown in FIG. 13. The provision of a manual trigger begins by the GWE providing an offer of a proposition regarding a gambling event to the user (1301). The provision of the offer may be used using an interface controlled by the ESE. The ESE receives an input (1305) from the user indicating an acceptance of the proposition. The acceptance may include an amount of RC wagers and/or any additional information the GWE needs for a wager on the proposition. Based upon the input action, the ESE determines is an acceptance and provides the acceptance to the GWE (1310). In response to the acceptance, a request (1315) for a gambling event or a group of events as part of the gambling game is then provided by the GWE to the RWE. The RWE then determines the result(s) of the gambling event(s) (1320). The result(s) of the gambling event(s) is then provided by the RWE to GWE (1325). The GWE then uses a function, f3, to determine how the result of the gambling event affects the set of game variables (1330). Any required updates 1335 of the game variable in the set of game variables are then provided by the GWE to the ESE. The ESE updates the set of game variables according to the received updates (1340) and presents the updated game to the user (1345).

In some embodiments, a player may make a wager directly in the gambling game without having the ESE or GWE mediate the wager request, with the results of the wager affecting the entertainment game. In these embodiments, a user or a player makes a request (1350) for a wager directly with an RWE, either using and ESE through GWE connection, or using a user interface supplied by the RWE. In response, the RWE then determines the result(s) of the gambling event(s) (1352). The result(s) 1354 of the gambling event(s) is then provided by the RWE to the player, and to the GWE. The gambling result(s) may be provided directly to the user or player via the GWE and within the context of the ESE and entertainment game, or may be communicated to the user or player using an interface provided by the RWE. The GWE then uses a function, f3, to determine how the result of the gambling event affects the set of game variables (1356). Any required updates 1358 of the game variable in the set of game variables are then provided by the GWE to the ESE. The ESE updates the set of game variables according to the received updates (1360) and presents the updated game to the user (1362).

Figure 14:
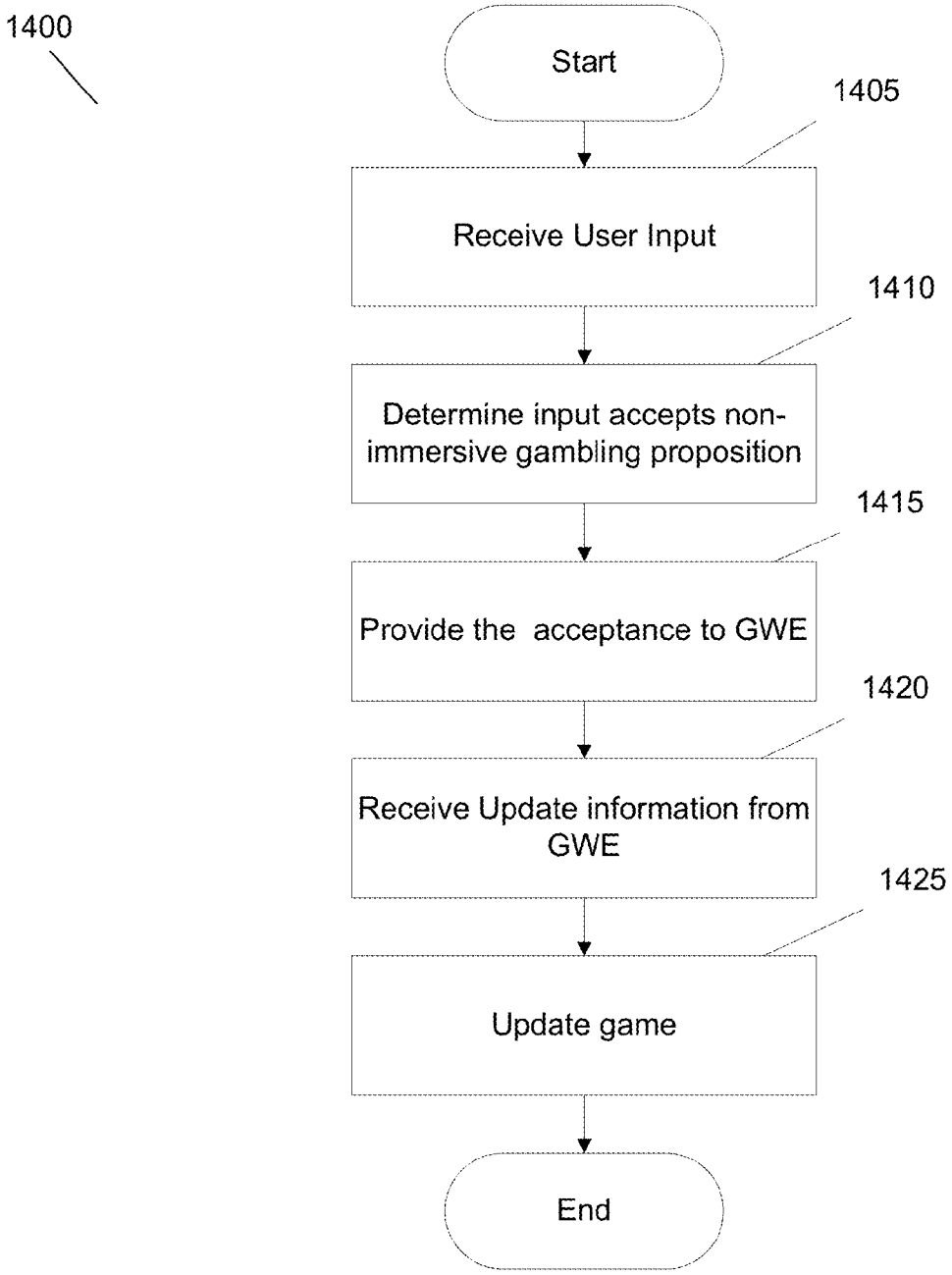
FIG. 14 illustrates a flow diagram of a process performed by an Entertainment System Engine to provide a gambling hybrid game having manual trigger of a gambling event in accordance with embodiments of the invention.

A process for receiving the input from the user accepting the gambling proposition on a gambling event provided by the GWE and updating the gambling hybrid game based on the results of a gambling event in accordance with embodiments of the invention is shown in FIG. 14. In process 1400, the ESE receives the input from the user (1405). The ESE determines the input is an acceptance of the proposition (1410) and provides the acceptance to the GWE (1415). The update information for the game variables based upon the results of the gambling event is received from the GWE (1420) and the ESE updates the game accordingly (1425).

Figure 15:
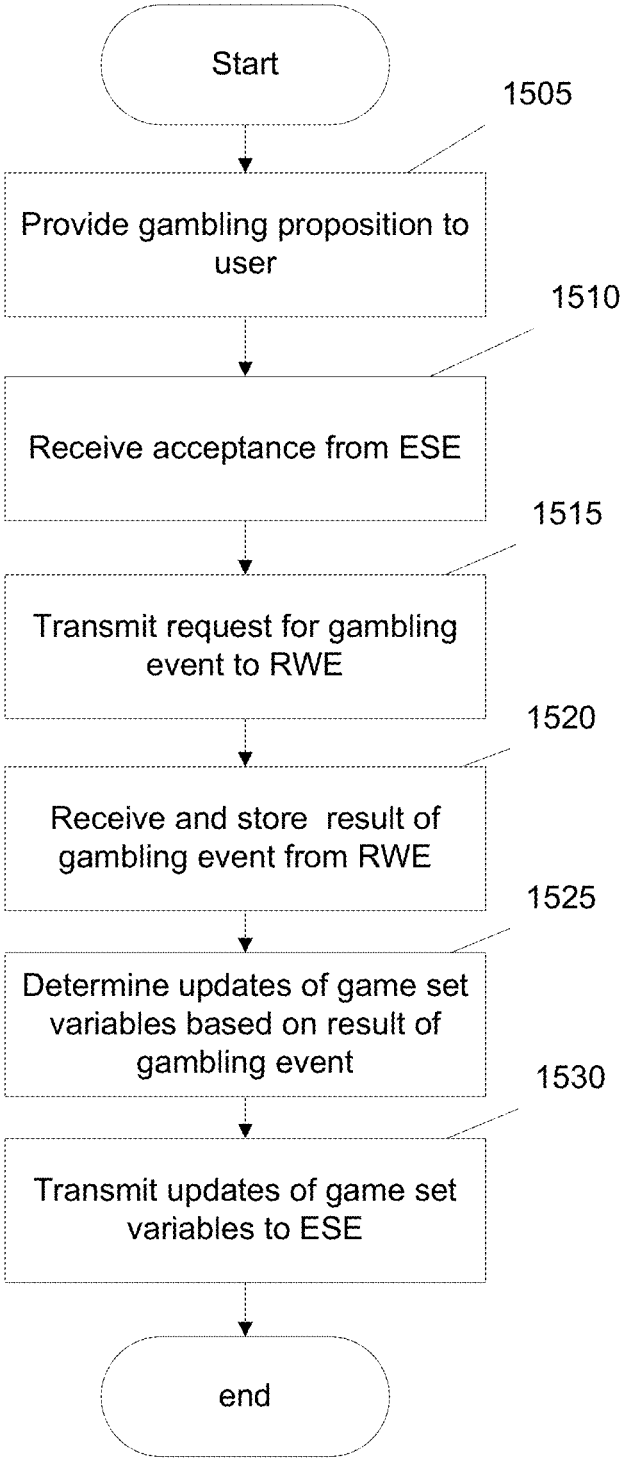
FIG. 15 illustrates a flow diagram of a process performed by a Game World Engine to provide a gambling hybrid game having manual trigger of a gambling event in accordance with embodiments of the invention.

A process for requesting a gambling event based upon an acceptance of a gambling proposition and determining how the results of the gambling event affect the variables of an entertainment game performed by a GWE in accordance with embodiments of the invention is shown in FIG. 15. In process 1500, the GWE provides a proposition on a gambling event to the user via the ESE (1505). The GWE receives the acceptance of the proposition from the ESE (1510). The GWE requests that gambling event upon which the proposition is based be performed by the RWE (1515). The request may include the amount of RWC wager on the proposition. The GWE then receives the results of the gambling event from the RWC (1520). The results provided to the GWE may also include RNG results and other information. The GWE may store the results and/or other information received in a database for use in determination of future gambling events. The results of the gambling events are used by the GWE to determine updates of the game variables (1525). The updates are transmitted by the GWE to the ESE (1530).

Figure 16:
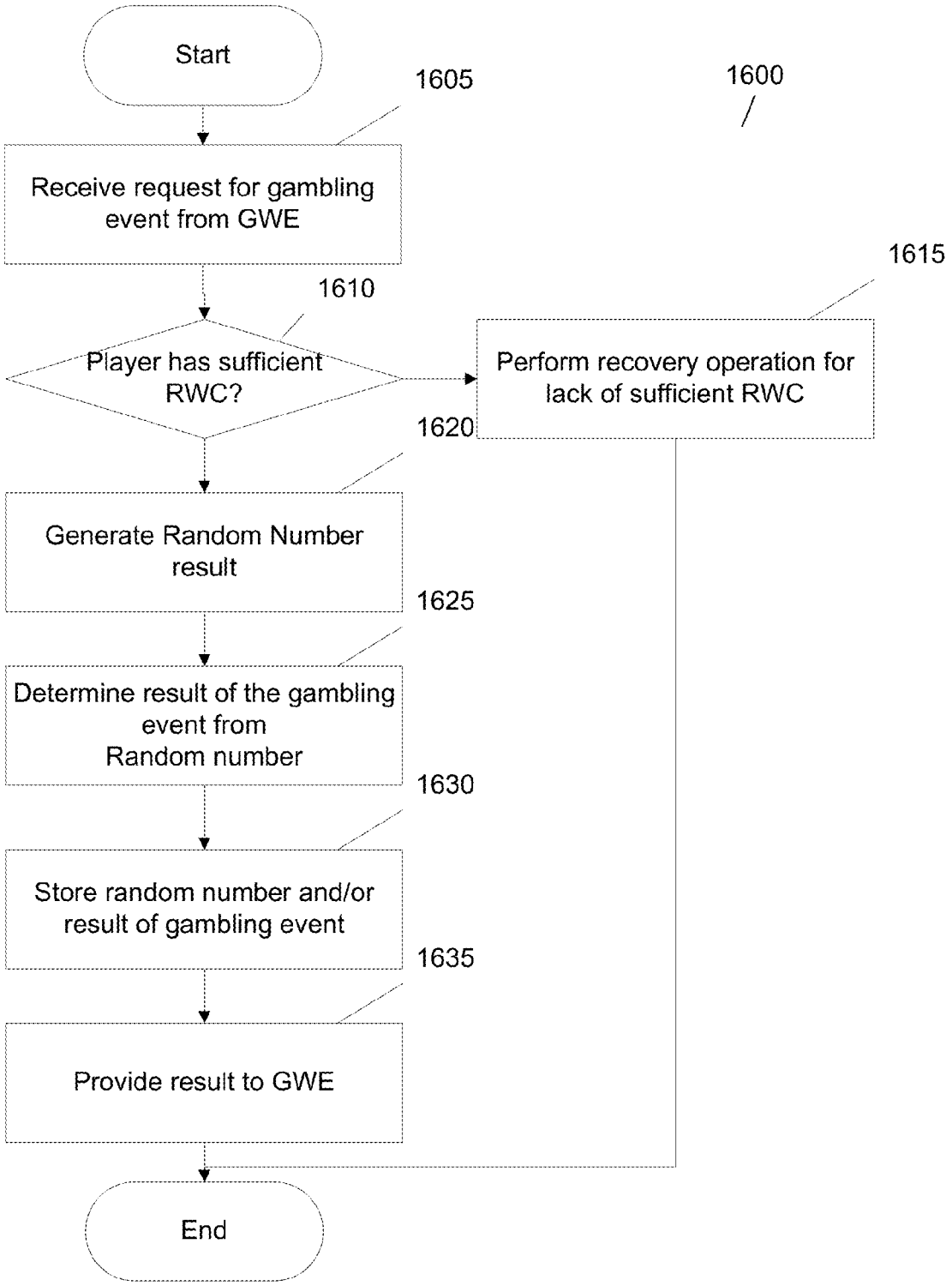
FIG. 16 illustrates a flow diagram of a process performed by Real World Engine to provide a gambling hybrid game having manual trigger of a gambling event in accordance with embodiments of the invention.

A process performed by the RWE to determine the results of the gambling events and provide the results to the GWE in accordance with embodiments of the invention is shown in FIG. 16. In process 1600, the RWE receives a request for a gambling event from the GWE (1605). The request may include amount wagered, an indication of a proper RNG to use, and an indication of the pay tables to use to resolve the wager. The RWE determines whether the user has sufficient RWC available to cover the wager (1610). If the client does not have sufficient RWC to cover the wager, the RWE performs a recovery operation (1615). The recovery operation may prevent the wager from occurring or may allow the user to supply the necessary funds to cover the wager. If the user has sufficient RWC, the RWE generates a random number result using the proper RNG (1620). The random number result is then used to determine the results of the gambling event and do all other appropriate operations for updating the RWC available to the user (1625). The RWE may store the result and/or other information about the result, including the random number result, in a database for future use (1630). The RWE also provides the result of the gambling event to the GWE (1635).

Although certain specific features and aspects of a gaming system have been described herein, many additional modifications and variations would be apparent to those skilled in the art. For example, the features and aspects described herein may be implemented independently, cooperatively or alternatively without deviating from the spirit of the disclosure. It is therefore to be understood that gaming system may be practiced otherwise than as specifically described. Thus, the foregoing description of the gaming system should be considered in all respects as illustrative and not restrictive, the scope of the claims to be determined as supported by this disclosure and the claims' equivalents, rather than the foregoing description.

What is claimed is:

1. A gambling hybrid game provided on a computing device that includes manual triggering of a gambling event, comprising:

an entertainment engine constructed to:

execute an entertainment game including receiving an input of the player while playing the entertainment game;

generate a visual representation of the entertainment game;

receive from a game world engine a wager result; and generate a visual representation of the wager result;

a game world engine constructed to manage the entertainment game being provided to the player by entertainment engine and generate a gambling event request based on the player inputs as provided during play of the entertainment game;

a real world engine constructed to receive gambling event requests from the game world engine and from the player of the entertainment game, determine results of the gambling event requests, generate the wager results using a random number generator and a pay table for the gambling event requests, manage real word credits of a player based on the wagers, and distribute the wager results to the game world engine;

wherein the game world engine is further constructed to:

provide an initial gambling proposition at the beginning of play of the entertainment game;

set initial conditions of the entertainment game based upon the result of the initial gambling event;

receive the wager results from the real world engine, determine changes in a set of entertainment game variables based on the wager results, and distribute the changes in the set of game variables to the entertainment engine;

wherein the entertainment engine is further constructed to:

receive the changes to the set of game variables from the game world engine; and incorporate the changes to the set of game variables into the entertainment game.

2. The gambling hybrid game of claim 1 wherein the game world engine is constructed to provide a gambling proposition based upon game play of the entertainment game reaching a particular juncture and the gambling proposition changes the conditions of the game based upon the results of the gambling event.

3. The gambling hybrid game of claim 1 wherein the entertainment engine is constructed to pause play of the entertainment game during the resolution of the gambling event.

4. The gambling hybrid game of claim 1 wherein the change of the set of game variables by the game world engine is based upon the result of the gambling event and an amount of real world credits wagered on the proposition by the user.

5. The gambling hybrid game of claim 1 wherein the entertainment engine presents the updated game to the user and allows the user to accept or reject the updated game.

6. A method for providing a gambling hybrid game on a computing device with manual triggering of a gambling event comprising:

performing by an entertainment engine:

executing an entertainment game including receiving an input of the player while playing the entertainment game;

generating a visual representation of the entertainment game;

receiving from a game world engine a wager result; and generating a visual representation of the wager result;

providing a game world engine constructed to manage the entertainment game being provided to the player by entertainment engine and generate a gambling event request based on the player inputs as provided during play of the entertainment game;

providing a real world engine constructed to receive gambling event requests from the game world engine and from the player of the entertainment game, determine results of the gambling event requests, generate wager results using a random number generator and a pay table for the gambling event requests based on the results, manage real word credits of a player based on the wagers, and distribute the wager results to the game world engine;

performing the following by the game world engine:

providing an initial gambling proposition at the beginning of play of the entertainment game;

setting initial conditions of the entertainment game based upon the result of the initial gambling event;

receiving the wager results from the real world engine, determining changes in a set of entertainment game variables based on the wager results, and distributing the changes in the set of game variables to the entertainment engine;

performing the following by the entertainment engine:

receiving the changes to the set of game variables from the game world engine; and incorporating the changes to the set of game variables into the entertainment game.

7. The method of claim 6, further comprising providing a gambling proposition is provided by the game world engine based upon game play of the entertainment game reaching a particular juncture and the gambling proposition changes the conditions of the game based upon the results of the gambling event.

8. The method of claim 6, further comprising pausing play of the entertainment game during the resolution of the gambling event by the entertainment engine.

9. The method of claim 6, wherein the changing of the set of game variables by the game world engine is based upon the result of the gambling event and an amount of real world credits wagered on the proposition by the user.

10. The method of claim 6 further comprising:

presenting the updated game to the user using the entertainment engine; and receiving an input accepting the updated game.

11. A machine readable medium containing processor instructions, where execution of the instructions by a processor causes the processor to perform a process for providing a gambling hybrid game with manual triggering of a gambling event comprising:

performing by an entertainment engine:

executing an entertainment game including receiving an input of the player while playing the entertainment game;

generating a visual representation of the entertainment game;

receiving from a game world engine a wager result; and generating a visual representation of the wager result;

providing a game world engine constructed to manage the entertainment game being provided to the player by entertainment engine and generate a gambling event request based on the player inputs as provided during play of the entertainment game;

providing a real world engine constructed to receive gambling event requests from the game world engine and from the player of the entertainment game, determine results of the gambling event requests, generate wager results using a random number generator and a pay table for the gambling event requests based on the results, manage real word credits of a player based on the wagers, and distribute the wager results to the game world engine;

performing the following by the game world engine:

providing an initial gambling proposition at the beginning of play of the entertainment game;

setting initial conditions of the entertainment game based upon the result of the initial gambling event;

receiving the wager results from the real world engine, determining changes in a set of entertainment game variables based on the wager results, and distributing the changes in the set of game variables to the entertainment engine;

performing the following by the entertainment engine:

receiving the changes to the set of game variables from the game world engine; and incorporating the changes to the set of game variables into the entertainment game.

12. The machine readable medium of claim 11, the instructions further comprising providing a gambling proposition by the game world engine to the player based upon game play of the entertainment game reaching a particular juncture and the gambling proposition changes the conditions of the game based upon the results of the gambling event.

13. The machine readable medium of claim 11 the instructions further comprising pausing play of the entertainment game during the resolution of the gambling event, by the entertainment engine.

14. The machine readable medium of claim 11, wherein the changing of the set of game variables by the game world engine is based upon the result of the gambling event and an amount of real world credits wagered on the proposition by the player.

15. The machine readable medium of claim 11, the instructions further comprising:

presenting the updated game to the user using the entertainment engine; and receiving an input accepting the updated game.

* * * * *